US009875751B2

(12) United States Patent
Eggerding et al.

(10) Patent No.: US 9,875,751 B2
(45) Date of Patent: Jan. 23, 2018

(54) AUDIO PROCESSING SYSTEMS AND METHODS

(71) Applicant: Dolby Laboratories Licensing Corporation, San Francisco, CA (US)

(72) Inventors: Timothy James Eggerding, Oakland, CA (US); Christian Wolff, San Leandro, CA (US); Adam Christopher Noel, Phoenix, AZ (US); David Matthew Fischer, San Francisco, CA (US); Sergio Martinez, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/329,909

(22) PCT Filed: Jul. 27, 2015

(86) PCT No.: PCT/US2015/042190
§ 371 (c)(1),
(2) Date: Jan. 27, 2017

(87) PCT Pub. No.: WO2016/018787
PCT Pub. Date: Feb. 4, 2016

(65) Prior Publication Data

US 2017/0243596 A1 Aug. 24, 2017

Related U.S. Application Data

(60) Provisional application No. 62/031,723, filed on Jul. 31, 2014.

(51) Int. Cl.
*G10L 19/20* (2013.01)
*G10L 19/008* (2013.01)
(Continued)

(52) U.S. Cl.
CPC ..... *G10L 19/20* (2013.01); *G10L 19/008* (2013.01); *G10L 19/018* (2013.01);
(Continued)

(58) Field of Classification Search
CPC ..... G10L 19/20; G10L 19/008; G10L 19/018; G10L 19/167; H04S 3/008; H04S 5/00; H04S 2400/11
See application file for complete search history.

(56) References Cited

U.S. PATENT DOCUMENTS 5,949,410 A 9/1999 Fung
6,043,851 A 3/2000 Sawada
(Continued)

FOREIGN PATENT DOCUMENTS

GB 2501150 10/2013
WO 2010/076770 7/2010
(Continued)

OTHER PUBLICATIONS

Kim, K.H. et al "Structuring of an Adaptive Multi-channel Audio-Play System Based on the TMO Scheme" IEEE 13th International Symposium on Object/Component/Service-Oriented Real-Time Distributed Computing Workshops, May 4-7, 2010, pp. 233-239.
(Continued)

*Primary Examiner* — Sonia Gay

(57) ABSTRACT

Embodiments are directed processing adaptive audio content by determining an audio type as one of channel-based audio and object-based audio for each audio segment of an adaptive audio bitstream, tagging the each audio segment with a metadata definition indicating the audio type of the corresponding audio segment, processing audio segments tagged as channel-based audio in a channel audio renderer component, and processing audio segments tagged as object-based audio in an object audio renderer component
(Continued)

that is distinct from the channel audio renderer component. Object-based audio is rendered through an object audio renderer interface that dynamically adjusts processing block sizes of the object audio segments based on timing and alignment of metadata updates and maximum/minimum block size parameters.

18 Claims, 12 Drawing Sheets

(51) Int. Cl.

| | |
|---|---|
| ***G10L 19/16*** | (2013.01) |
| ***H04S 3/00*** | (2006.01) |
| ***H04S 5/00*** | (2006.01) |
| ***G10L 19/018*** | (2013.01) |

(52) U.S. Cl.
CPC ..... *G10L 19/167* (2013.01); *H04S 3/008* (2013.01); *H04S 5/00* (2013.01); *H04S 2400/11* (2013.01)

(56) References Cited

U.S. PATENT DOCUMENTS

| | | | | |
|---|---|---|---|---|
| 7,167,108 | B2 | 1/2007 | Chu | |
| 7,227,964 | B2 * | 6/2007 | Abe | G10L 21/0208 381/123 |
| 7,308,188 | B2 | 12/2007 | Namatame | |
| 7,319,703 | B2 | 1/2008 | Lakaniemi | |
| 8,170,226 | B2 | 5/2012 | Prakash | |
| 8,190,441 | B2 | 5/2012 | Kincaid | |
| 8,275,233 | B2 | 9/2012 | Henry | |
| 8,462,847 | B2 | 6/2013 | Wu | |
| 8,612,187 | B2 | 12/2013 | Amadu | |
| 2007/0199043 | A1 | 8/2007 | Morris | |
| 2007/0208571 | A1 | 9/2007 | Lemieux | |
| 2009/0100493 | A1 | 4/2009 | Jones | |
| 2010/0091189 | A1 | 4/2010 | Fukuyama | |
| 2010/0223552 | A1 | 9/2010 | Metcalf | |
| 2011/0276864 | A1 | 11/2011 | Oules | |
| 2011/0276975 | A1 | 11/2011 | Brown | |
| 2012/0089390 | A1 | 4/2012 | Yang | |
| 2012/0297027 | A1 | 11/2012 | Oren | |
| 2012/0328109 | A1 | 12/2012 | Harma | |
| 2013/0044260 | A1 | 2/2013 | Vestergaard | |
| 2013/0238992 | A1 | 9/2013 | Zhang | |
| 2014/0020021 | A1 | 1/2014 | Liu | |
| 2014/0064495 | A1 | 3/2014 | Cashin | |
| 2014/0133683 | A1 | 5/2014 | Robinson | |
| 2014/0139738 | A1 | 5/2014 | Mehta | |
| 2015/0170657 | A1 * | 6/2015 | Thompson | G10L 19/008 704/500 |

FOREIGN PATENT DOCUMENTS

| | | |
|---|---|---|
| WO | 2013/117806 | 8/2013 |
| WO | 2014/011487 | 1/2014 |
| WO | 2014/013070 | 1/2014 |
| WO | 2014/046944 | 3/2014 |
| WO | 2014/099285 | 6/2014 |

OTHER PUBLICATIONS

ISO/IEC JTC 1/SC 29 N "Information Technology—High Efficiency Coding and Media Delivery in Heterogeneous Environments—Part 3:3D Audio" Apr. 4, 2014, pp. 1-338.
Plogsties, J. et al "Object Interaction use Cases and Technology" ISO/IEC JTC/SC29/WG11 MPEG 2014, Mar. 2014, pp. 1-20.
Neuendorf, M. et al "Corrections to MPEG-H 3D Audio" ISO/IEC JTC1/SC29/WG11/M34264, Jul. 2014, Sapporo, Japan, pp. 1-11.
"Dolby Atmos Next-Generation Audio for Cinema" Apr. 1, 2012, URL:http:jjwww.dolby.comjuploadedFilesjAssets/US/Doc/Professional/Dolby-Atmos-Next-Generation-Audio-for-Cinema.pdf.
Kuntz, A. et al "Delay Handling in MPEG-H 3D Audio" ISO/IEC JTC1/SC29/WG11, Meeting of AHG on 3D Audio, DRC and Audio Maintenance, Jun. 2-3, 2014, Paris, France, pp. 1-9.

* cited by examiner

TABLE 1

| Field | Encoding | Valid Range in Bitstream | Description |
|---|---|---|---|
| sample_offset | unsigned int | [0, max_input_block_size-1] | This field is an input parameter to the object audio renderer interface that indicates the offset relative to the first sample in the input buffer to which the input evolution framework payload applies. |
| timestamp | variable_bit(11) | [0, frame_duration-1] | This field contains the offset in samples from the beginning of the evolution frame to which the payload in question belongs. |
| oa_sample_offset, oa_sample_offset_code, oa_sample_offset_type | u(5), v(2), v(2) | [0, 31] | The object audio metadata sample offset value indicates the number of samples between the start of the codec frame and the sample where the metadata block offset value takes effect. The value of the oa_sample_offset field is given by a combination of the oa_sample_offset, oa_sample_offset_code, and oa_sample_offset fields. |
| block_offset_factor | u(6) | [0, 63] | The block_offset_factor field describes the number of 32-sample blocks away from the oa_sample_offset value that the metadata block applies. |

FIG. 14

AUDIO PROCESSING SYSTEMS AND METHODS

CROSS-REFERENCE TO RELATED APPLICATIONS

This application claims priority from U.S. Provisional Patent Application No. 62/031,723 filed 31 Jul. 2014, which is hereby incorporated by reference in its entirety.

FIELD OF THE INVENTION

One or more implementations relate generally to audio signal processing, and more specifically to a method for smoothly switching between channel-based and object-based audio, and an associated object audio renderer interface for use in an adaptive audio processing system.

BACKGROUND

The introduction of digital cinema and the development of true three-dimensional ("3D") or virtual 3D content has created new standards for sound, such as the incorporation of multiple channels of audio to allow for greater creativity for content creators and a more enveloping and realistic auditory experience for audiences. Expanding beyond traditional speaker feeds and channel-based audio as a means for distributing spatial audio is critical, and there has been considerable interest in a model-based audio description that allows the listener to select a desired playback configuration with the audio rendered specifically for their chosen configuration. The spatial presentation of sound utilizes audio objects, which are audio signals with associated parametric source descriptions of apparent source position (e.g., 3D coordinates), apparent source width, and other parameters. Further advancements include a next generation spatial audio (also referred to as "adaptive audio") format has been developed that comprises a mix of audio objects and traditional channel-based speaker feeds along with positional metadata for the audio objects. In a spatial audio decoder, the channels are sent directly to their associated speakers or down-mixed to an existing speaker set, and audio objects are rendered by the decoder in a flexible (adaptive) manner. The parametric source description associated with each object, such as a positional trajectory in 3D space, is taken as an input along with the number and position of speakers connected to the decoder. The renderer then utilizes certain algorithms, such as a panning law, to distribute the audio associated with each object ("object-based audio") across the attached set of speakers. The authored spatial intent of each object is thus optimally presented over the specific speaker configuration that is present in the listening room.

In traditional channel-based audio systems, audio post-processing does not change over time due to changes in bitstream content. Since audio carried throughout the system is always identified using static channel identifiers (such as Left, Right, Center, etc.), individual audio post-processing technology may always remain active. An object-based audio system, however, uses new audio post-processing mechanisms that use specialized metadata to render object-based audio to a channel-based speaker layout. In practice, an object-based audio system must also support and handle channel-based audio, in part to support legacy audio content. Since channel-based audio lacks the specialized metadata that enables audio rendering, certain audio post-processing technologies may be different when the coded audio source contains object-based or channel-based audio. For example, an upmixer may be used to generate content for speakers that are not present in the incoming channel-based audio, and such an upmixer would not be applied to object-based audio.

In most present systems, an audio program generally contains only one type of audio, either object-based or channel-based, and thus the processing chain (rendering or upmixing) may be chosen at initialization time. With the advent of new audio formats, however, the audio type (channel or object) in a program may change over time, due to transmission medium, creative choice, user interaction, or other similar factors. In a hybrid audio system, it is possible for audio to switch between object-based and channel-based audio without changing the codec. In this case, the system optimally does not exhibit muting or audio delay, but rather provides a continuous audio stream to all of its speaker outputs by switching between rendered object output and upmixed channel output, since one problem in present audio systems is that they may mute or glitch on such a change in the bitstream.

For adaptive audio content having both objects and channels, modern Audio/Video Receiver (AVR) systems, such as those that may utilize Dolby® Atmos® technology or other adaptive audio standards, generally consist of one or more Digital Signal Processor (DSP) chips, and one or more microcontroller chips or cores of a single chip (e.g. a System on Chip, SoC). The microcontroller is responsible for managing the processing on the DSP and interacting with the user, while the DSP is optimized specifically to perform audio processing. When switching between object-based and channel-based audio, it may be possible for the DSP to signal the change to the microcontroller, which then uses logic to reconfigure the DSP to handle the new audio type. This type of signaling is referred to as "out-of-band" signaling since it occurs between the DSP and microcontroller. Such out-of-band signaling necessarily takes some amount of time due to factors such as processing overhead, transmission latencies, data switching overhead, and this often leads to unnecessary muting, or possible glitching of the audio if the DSP incorrectly processes the audio data.

What is needed, therefore, is a way to switch between object-based and channel-based content that provides a continuous or smooth audio stream without gaps, mutes, or glitches. What is further needed is a mechanism that allows an audio-processing DSP to select the correct processing chain for the incoming audio, without needing to communicate externally to other processors or microcontrollers.

With respect to object audio rendering systems having an object audio renderer, object-based audio comprises portions of digital audio data (e.g., samples of PCM audio) along with metadata that defines how the associated samples are to be rendered. The proper timing of the metadata updates with the corresponding samples of audio data is therefore important for accurate rendering of the audio objects. In a dynamic audio program with many objects and/or with objects that may move quickly around the sound space, the metadata updates may occur very quickly with respect to the audio frame rate. Present object-based audio processing systems are generally capable of handling metadata updates that occur regularly and at a rate that is within the processing capabilities of the decoder and rendering processors. Such systems often rely on audio frames that are of a set size and metadata updates that are applied at a uniformly periodic rate. However, as updates occur more quickly or in a non-uniformly periodic manner, processing the updates becomes much more challenging. Often, an update may not be properly aligned with the audio samples to which it applies, either because updates occur too quickly or synchronization slips between metadata updates and the corresponding audio samples. In this case, audio samples may be rendered according to improper metadata definitions.

What is further needed is a mechanism to adapt a codec decoded output to properly buffer and deserialize the metadata for adaptive audio systems in the most efficient way possible. What is further needed is an object audio renderer interface that is configured to ensure that object audio is rendered with the least amount of processing power and the high accuracy, and that is also adjustable to customer needs, depending on their chip architecture.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions. Dolby, Dolby Digital Plus, Dolby TrueHD, and Atmos are trademarks of Dolby Laboratories Licensing Corporation.

BRIEF SUMMARY OF EMBODIMENTS

Embodiments are directed to a method of processing adaptive audio content by determining an audio type as either channel-based or object-based for each audio segment of an adaptive audio bitstream, tagging each audio segment with a metadata definition indicating the audio type of the corresponding audio segment, processing audio segments tagged as channel-based audio in a channel audio renderer component, and processing audio segments tagged as object-based audio in an object audio renderer component that is distinct from the channel-based audio renderer component. The method further includes encoding the metadata definition as an audio type metadata element encoded as part of a metadata payload associated with each audio segment. The metadata definition may comprise a binary flag value that is set by a decoder and that is transmitted to the channel audio renderer component and object audio renderer component. For this embodiment, the binary flag value is decoded by the channel audio renderer component and object audio renderer component for each received audio segment and audio data in the audio segment is rendered by one of the channel audio renderer component and object audio renderer component based on the decoded binary flag value. The channel-based audio may comprise stereo or legacy surround-sound audio and the channel audio renderer component may comprise an upmixer or simple passthrough node, and the object audio renderer component may comprise an object audio renderer interface. The method may further include adjusting for transmission and processing latency between any two successive audio segments by pre-compensating for known latency differences during the initialization phase.

Embodiments are further directed to a method of rendering adaptive audio by receiving, in a decoder, input audio comprising channel-based audio and object-based audio segments encoded in an audio bitstream, detecting a change of type between the channel-based audio and object-based audio segments in the decoder, generating a metadata definition for each type of audio segment upon detection of the change of type, associating the metadata definition with the appropriate audio segment, and processing each audio segment in an appropriate post-decoder processing component depending on the associated metadata definition. The channel-based audio may comprise legacy surround-sound audio to be rendered through an upmixer of an adaptive audio rendering system, and the object-based audio may be rendered through an object audio renderer interface of the system. In an embodiment, the method further includes adjusting for processing latency between any two successive audio segments by pre-compensating for known latency differences during an initialization phase. The metadata definition for the method may comprise an audio-type flag encoded by the decoder as part of a metadata payload associated with the audio bitstream. For this embodiment, a first state of the flag indicates that an associated audio segment is channel-based audio and a second state of the flag indicates that the associated audio segment is object-based audio.

Embodiments are further directed to an adaptive audio rendering system having a decoder receiving an input audio bitstream having audio content and associated metadata, the audio content having an audio type comprising one of channel-based audio or object-based type audio at any one time, an upmixer coupled to the decoder for processing the channel-based audio, an object audio renderer interface coupled to the decoder in parallel with the upmixer for rendering the object-based audio through an object audio renderer, and a metadata element generator within the decoder configured to tag channel-based audio with a first metadata definition and to tag object-based audio with a second metadata definition. In this system, the upmixer receives both the tagged channel-based audio and tagged object-based audio from the decoder and processes only the channel-based audio; and the object audio renderer interface receives both the tagged channel-based audio and tagged object-based audio from the decoder and processes only the object-based audio. A metadata element generator may be configured to set a binary flag indicating the type of audio segment transmitted from the decoder to the upmixer and the object audio renderer interface, and wherein the binary flag is encoded by the decoder as part of a metadata payload associated with the bitstream. The channel-based audio may comprise surround-sound audio beds, the audio objects may comprise objects conforming to an object audio metadata (OAMD) format. In an embodiment, the system further comprises a latency manager configured to adjust for latency between any two successive audio segments by pre-compensating for known latencies during an initialization phase to provide time-aligned output of different signal paths through the upmixer and object audio renderer interface for the successive audio segments. In some embodiments, the upmixer may be replaced with a simple passthrough node that maps input audio channels to output speakers.

Embodiments are also directed to a method of processing object-based audio by receiving, in an object audio renderer interface (OARI), a block of audio samples and one or more associated object audio metadata payloads, de-serializing one or more audio block updates from each object audio metadata payload, storing the audio samples and the audio block updates in respective audio sample and audio block update memory caches, and dynamically selecting processing block sizes of the audio samples based on timing and alignment of audio block updates relative to processing block boundaries, and one or more other parameters including maximum/minimum processing block size parameters. The method may further comprise transmitting the object-based audio from the OARI to the OAR in processing blocks of sizes determined by the dynamic selection. Each metadata element is passed in a metadata frame with a sample offset indicating at which sample in an audio block the frame applies. The method may further comprise preparing the metadata containing the metadata elements through one or more processes including object prioritization, width removal, disabled object handling, filtering of excessively frequent updates, spatial position clipping to a desired range, and converting update data into a desired format. The OAR may support a limited number of processing block sizes, such as 32, 64, 128, 256, 480, 512, 1024, 1536, or 2048 samples in length, but is not so limited. In an embodiment, the processing block size selection is made such that the audio block update is located as near to the first sample of the processing block as allowed by a processing block size selection parameter. The processing block size may be selected to be as large as possible as constrained by audio block update location, OAR processing block sizes, and OARI maximum and minimum block size parameter values. The metadata frames may contain metadata defining attributes regarding rendering of one or more objects in the block of audio samples, the attributes selected from the group consisting of: content-type attributes including dialog, music, effect, Foley, background, and ambience definitions; spatial attributes including 3D position, object size, and object velocity; and speaker rendering attributes including snap to speaker location, channel weights, gain, ramp, and bass management information.

Embodiments are further directed to a method of processing audio objects by receiving, in an object audio renderer interface (OARI), a block of audio samples and associated metadata that defines how the audio samples are rendered in an object audio renderer (OAR), wherein the metadata is updated over time to define different rendering attributes of the audio objects, buffering the audio samples and metadata updates to be processed by the OAR in an arrangement of processing blocks, dynamically selecting processing block sizes based on timing and alignment of metadata updates relative to block boundaries, and one or more other parameters including: maximum/minimum block size parameters, and transmitting the object-based audio from the OARI to the OAR in blocks of sizes determined by the dynamic selection step. The method may further comprise storing the audio data and block updates for each block in respective audio and update memory caches, wherein the block updates are encoded in metadata elements stored in object audio metadata payloads. Each metadata element may be passed in a metadata frame with a sample offset indicating at which sample in a processing block the frame applies. The block size selection may be made such that the block update is located as near to the first sample of the block as allowed by the minimum output block size selection. In an embodiment, the block size is selected to be as large as possible as constrained by block update location, OAR block sizes, and OARI maximum block size parameter values. The method may further comprise preparing the metadata containing the metadata elements through one or more processes including object prioritization, width removal, disabled object handling, filtering of excessively frequent updates, spatial position clipping to a desired range, and converting update data into a desired format.

Embodiments are yet further directed to a method of processing adaptive audio data, by determining through a defined metadata definition whether audio to be processed is channel-based audio or object-based audio, processing the audio through a channel-based audio renderer (CAR) if channel-based, and processing the audio through an object-based audio renderer (OAR) if object-based, wherein the OAR utilizes an OAR interface (OARI) that dynamically adjusts processing block sizes of the audio based on timing and alignment of metadata updates and one or more other parameters including maximum and minimum block sizes.

Embodiments are also directed to a method of switching between channel-based or object-based audio rendering by encoding a metadata element with an audio block to have a first state indicating channel-based audio content or a second state indicating object-based audio content, transmitting the metadata element as part of an audio bitstream to a decoder, decoding the metadata element in the decoder to route channel-based audio content to channel audio renderer (CAR) if the metadata element is of the first state and object-based audio content to an object audio renderer (OAR) if the metadata element is of the second state. In this method, the metadata element comprises a metadata flag that is transmitted in-band with a pulse code modulated (PCM) audio bitstream transmitted to the decoder. The CAR may comprise one of an upmixer or a passthrough node that maps input channels of the channel-based audio to output speakers; and the OAR comprises a renderer that utilizes an OAR interface (OARI) that dynamically adjusts processing block sizes of the audio based on timing and alignment of metadata updates and one or more other parameters including maximum and minimum block sizes.

Embodiments are yet further directed to digital signal processing systems that implement the aforementioned methods and/or speaker systems that incorporate circuitry implementing at least some of the aforementioned methods.

INCORPORATION BY REFERENCE

Each publication, patent, and/or patent application mentioned in this specification is herein incorporated by reference in its entirety to the same extent as if each individual publication and/or patent application was specifically and individually indicated to be incorporated by reference.

BRIEF DESCRIPTION OF THE DRAWINGS

In the following drawings like reference numbers are used to refer to like elements. Although the following figures depict various examples, the one or more implementations are not limited to the examples depicted in the figures.

FIG. 14 illustrates a table that lists fields used in the calculation of the offset field in an internal data structure, under an embodiment.

DETAILED DESCRIPTION

Figure 1:
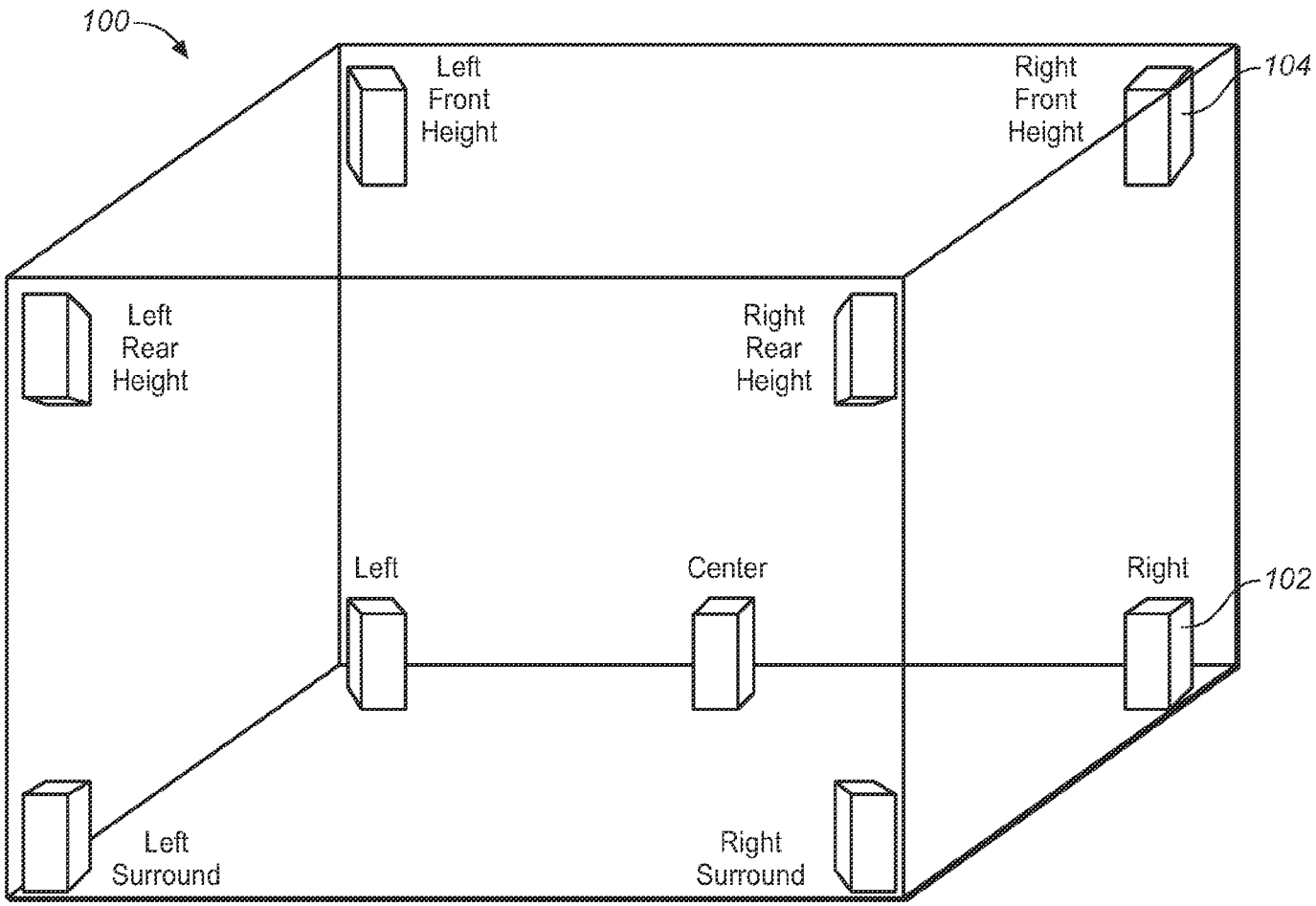
FIG. 1 illustrates an example speaker placement in a surround system (e.g., 9.1 surround) that provides height speakers for playback of height channels.

Systems and methods are described for switching between object-based and channel-based audio in an adaptive audio system that allows for playback of a continuous audio stream without gaps, mutes, or glitches. Embodiments are also described for an associated object audio renderer interface that produces dynamically selected processing block sizes to optimize processor efficiency and memory usage while maintaining proper alignment of object audio metadata with the object audio PCM data in an object audio renderer of an adaptive audio processing system. Aspects of the one or more embodiments described herein may be implemented in an audio or audio-visual system that processes source audio information in a mixing, rendering and playback system that includes one or more computers or processing devices executing software instructions. Any of the described embodiments may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

For purposes of the present description, the following terms have the associated meanings: the term "channel" means an audio signal plus metadata in which the position is coded as a channel identifier, e.g., left-front or right-top surround; "channel-based audio" is audio formatted for playback through a pre-defined set of speaker zones with associated nominal locations, e.g., 5.1, 7.1, and so on; the term "object" or "object-based audio" means one or more audio channels with a parametric source description, such as apparent source position (e.g., 3D coordinates), apparent source width, etc.; "adaptive audio" means channel-based and/or object-based audio signals plus metadata that renders the audio signals based on the playback environment using an audio stream plus metadata in which the position is coded as a 3D position in space; the term "adaptive streaming" refers to an audio type that may adaptively change (e.g., from channel-based to object-based or back again), and which is common for online streaming applications where the format of the audio must scale to varying bandwidth constraints (i.e., as object audio tends to come at higher data rates, the fallback under lower bandwidth conditions is often channel based audio); and "listening environment" means any open, partially enclosed, or fully enclosed area, such as a room that can be used for playback of audio content alone or with video or other content, and can be embodied in a home, cinema, theater, auditorium, studio, game console, and the like.

Adaptive Audio Format and System

In an embodiment, the interconnection system is implemented as part of an audio system that is configured to work with a sound format and processing system that may be referred to as a "spatial audio system," "hybrid audio system," or "adaptive audio system." Such a system is based on an audio format and rendering technology to allow enhanced audience immersion, greater artistic control, and system flexibility and scalability. An overall adaptive audio system generally comprises an audio encoding, distribution, and decoding system configured to generate one or more bitstreams containing both conventional channel-based audio elements and audio object coding elements (object-based audio). Such a combined approach provides greater coding efficiency and rendering flexibility compared to either channel-based or object-based approaches taken separately.

An example implementation of an adaptive audio system and associated audio format is the Dolby® Atmos® platform. Such a system incorporates a height (up/down) dimension that may be implemented as a 9.1 surround system, or similar surround sound configurations. Such a height-based system may be designated by different nomenclature where height speakers are differentiated from floor speakers through an x.y.z designation where x is the number of floor speakers, y is the number of subwoofers, and z is the number of height speakers. Thus, a 9.1 system may be called a 5.1.4 system comprising a 5.1 system with 4 height speakers.

FIG. 1 illustrates the speaker placement in a present surround system (e.g., 5.1.4 surround) that provides height speakers for playback of height channels. The speaker configuration of system 100 is composed of five speakers 102 in the floor plane and four speakers 104 in the height plane. In general, these speakers may be used to produce sound that is designed to emanate from any position more or less accurately within the room. Predefined speaker configurations, such as those shown in FIG. 1, can naturally limit the ability to accurately represent the position of a given sound source. For example, a sound source cannot be panned further left than the left speaker itself. This applies to every speaker, therefore forming a one-dimensional (e.g., left-right), two-dimensional (e.g., front-back), or three-dimensional (e.g., left-right, front-back, up-down) geometric shape, in which the downmix is constrained. Various different speaker configurations and types may be used in such a speaker configuration. For example, certain enhanced audio systems may use speakers in a 9.1, 11.1, 13.1, 19.4, or other configuration, such as those designated by the x.y.z configuration. The speaker types may include full range direct speakers, speaker arrays, surround speakers, subwoofers, tweeters, and other types of speakers.

Audio objects can be considered groups of sound elements that may be perceived to emanate from a particular physical location or locations in the listening environment. Such objects can be static (i.e., stationary) or dynamic (i.e., moving). Audio objects are controlled by metadata that defines the position of the sound at a given point in time, along with other functions. When objects are played back, they are rendered according to the positional metadata using the speakers that are present, rather than necessarily being output to a predefined physical channel. A track in a session can be an audio object, and standard panning data is analogous to positional metadata. In this way, content placed on the screen might pan in effectively the same way as with channel-based content, but content placed in the surrounds can be rendered to an individual speaker if desired. While the use of audio objects provides the desired control for discrete effects, other aspects of a soundtrack may work effectively in a channel-based environment. For example, many ambient effects or reverberation actually benefit from being fed to arrays of speakers. Although these could be treated as objects with sufficient width to fill an array, it is beneficial to retain some channel-based functionality.

Figure 2:
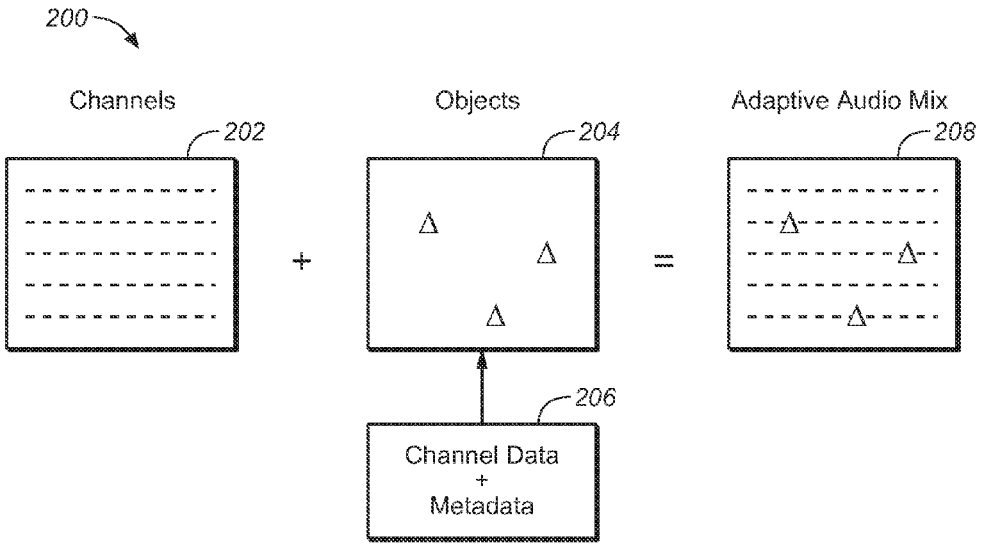
FIG. 2 illustrates the combination of channel and object-based data to produce an adaptive audio mix, under an embodiment.

The adaptive audio system is configured to support audio beds in addition to audio objects, where beds are effectively channel-based sub-mixes or stems. These can be delivered for final playback (rendering) either individually, or combined into a single bed, depending on the intent of the content creator. These beds can be created in different channel-based configurations such as 5.1, 7.1, and 9.1, and arrays that include overhead speakers, such as shown in FIG. 1. FIG. 2 illustrates the combination of channel and object-based data to produce an adaptive audio mix, under an embodiment. As shown in process 200, the channel-based data 202, which, for example, may be 5.1 or 7.1 surround sound data provided in the form of pulse-code modulated (PCM) data is combined with audio object data 204 to produce an adaptive audio mix 208. The audio object data 204 is produced by combining the elements of the original channel-based data with associated metadata that specifies certain parameters pertaining to the location of the audio objects. As shown conceptually in FIG. 2, the authoring tools provide the ability to create audio programs that contain a combination of speaker channel groups and object channels simultaneously. For example, an audio program could contain one or more speaker channels optionally organized into groups (or tracks, e.g., a stereo or 5.1 track), descriptive metadata for one or more speaker channels, one or more object channels, and descriptive metadata for one or more object channels.

For the adaptive audio mix 208, a playback system can be configured to render and playback audio content that is generated through one or more capture, pre-processing, authoring and coding components that encode the input audio as a digital bitstream. An adaptive audio component may be used to automatically generate appropriate metadata through analysis of input audio by examining factors such as source separation and content type. For example, positional metadata may be derived from a multi-channel recording through an analysis of the relative levels of correlated input between channel pairs. Detection of content type, such as speech or music, may be achieved, for example, by feature extraction and classification. Certain authoring tools allow the authoring of audio programs by optimizing the input and codification of the sound engineer's creative intent allowing him to create the final audio mix once that is optimized for playback in practically any playback environment. This can be accomplished through the use of audio objects and positional data that is associated and encoded with the original audio content. Once the adaptive audio content has been authored and coded in the appropriate codec devices, it is decoded and rendered for playback through speakers, such as shown in FIG. 1.

Figure 3:
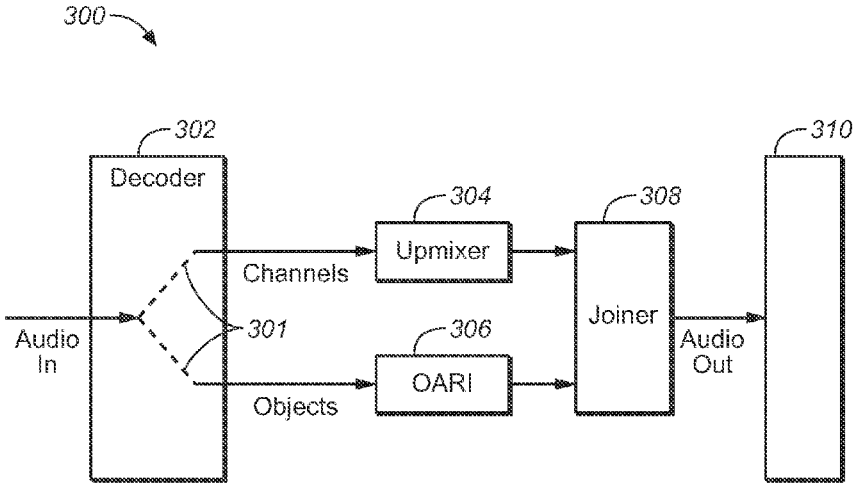
FIG. 3 is a block diagram of an adaptive audio system that processes channel-based and object-based audio, under an embodiment.

FIG. 3 is a block diagram of an adaptive audio system that processes channel-based and object-based audio, under an embodiment. As shown in system 300, input audio including object-based audio including object metadata, as well as channel-based audio are input as an input audio bitstream (audio in) to one or more decoder circuits within decoding/rendering (decoder) subsystem 302. The audio in bitstream encodes various audio components, such as channels (audio beds) with associated speaker or channels identifiers, and various audio objects (e.g., static or dynamic objects) with associated object metadata. In an embodiment, only one type of audio, object or channel, is input at any particular time, but the audio input stream may switch between these two types of audio content periodically or somewhat frequently during the course of a program. An object-based stream may contain both channels and objects, with both the channels and the objects, and the objects can be different types: bed objects (i.e., channels), dynamic objects, and ISF (Intermediate Spatial Format) objects. ISF is a format that optimizes the operation of audio object panners by splitting the panning operation into two parts: a time-varying part and a static part, and other similar objects may also be processed by the system. The OAR handles all these types simultaneously, while the CAR is used to do blind upmixing of legacy channel based content or function as a passthrough node.

The processing of the audio after decoder 302 is generally different for channel-based audio versus object-based audio. Thus, for the embodiment of FIG. 3, the channel-based audio is shown as being processed through an upmixer 304 or other channel-based audio processor, while the object-based audio is shown as being processed through an object audio renderer interface (OARI) 306. The CAR component may comprise an upmixer as shown, or it may comprise a simple passthrough node that maps input audio channels to output speakers, or it may be any other appropriate channel-based processing component. The processed audio is then multiplexed or joined together in a joiner component 308 or similar combinatorial circuit, and the resulting audio output is then sent to the appropriate speaker or speakers 310 in a speaker array, such as array 100 of FIG. 1.

For the embodiment of FIG. 3, the audio input may comprise channels and objects along with their respective associated metadata or identifier data. The encoded audio bitstream thus contains both types of audio data as it is input to the decoder 302. In an embodiment, the decoder 302 contains a switching mechanism 301 that utilizes in-band signaling metadata to switch between object and channel based audio data so that each particular type of audio content is routed to the appropriate processor 304 or 306. By using such signaling metadata, a coded audio source may signal a switch between object and channel based audio 301. In an embodiment, the signaling metadata signal is transmitted "in-band" with the audio input bitstream and serves to activate the downstream processes, such as audio rendering 306 or upmixing 304. This allows for a continuous audio stream without gaps, mutes, glitches, or audio/video synchronization drift. At initialization time, the decoder 302 is prepared to process both object-based and channel-based audio. When a change occurs between audio type, metadata is generated internal to the decoder DSP and is transmitted between audio processing blocks. By utilizing this metadata, it is possible to allow the DSP to select the correct processing chain for the incoming audio, without needing to communicate externally to other DSPs or microcontrollers. This allows a coded audio source to signal a switch between object-based and channel-based audio through a metadata signal that is transmitted with the audio content.

Figure 4A:
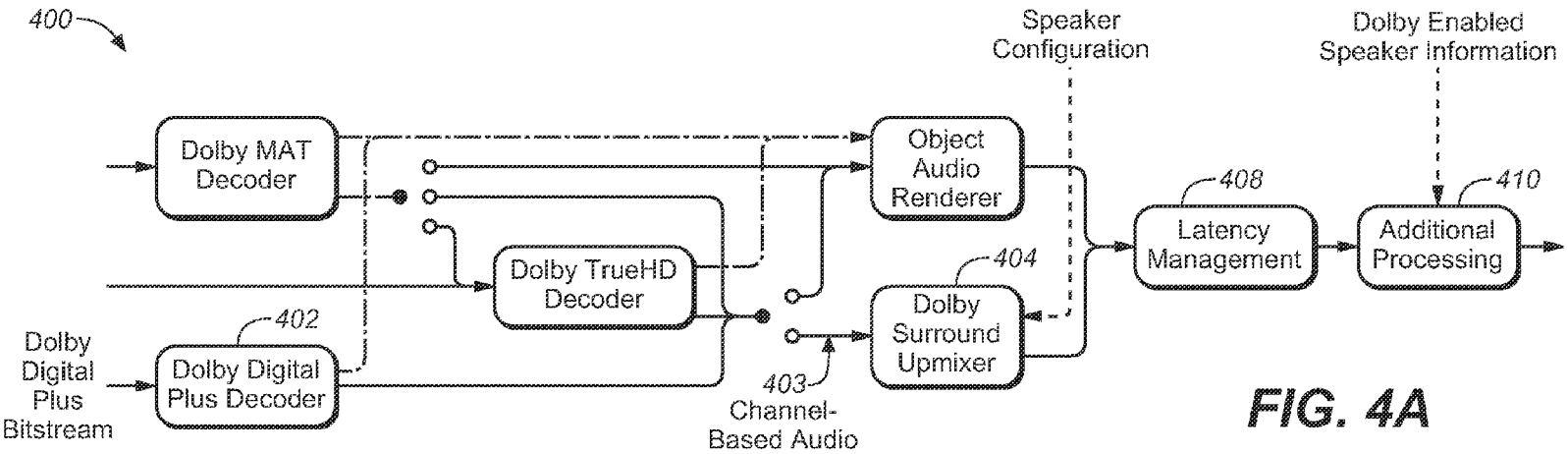
FIG. 4A illustrates a processing path for channel-based decoding and upmixing in an adaptive audio AVR system, under an embodiment.
Figure 4B:
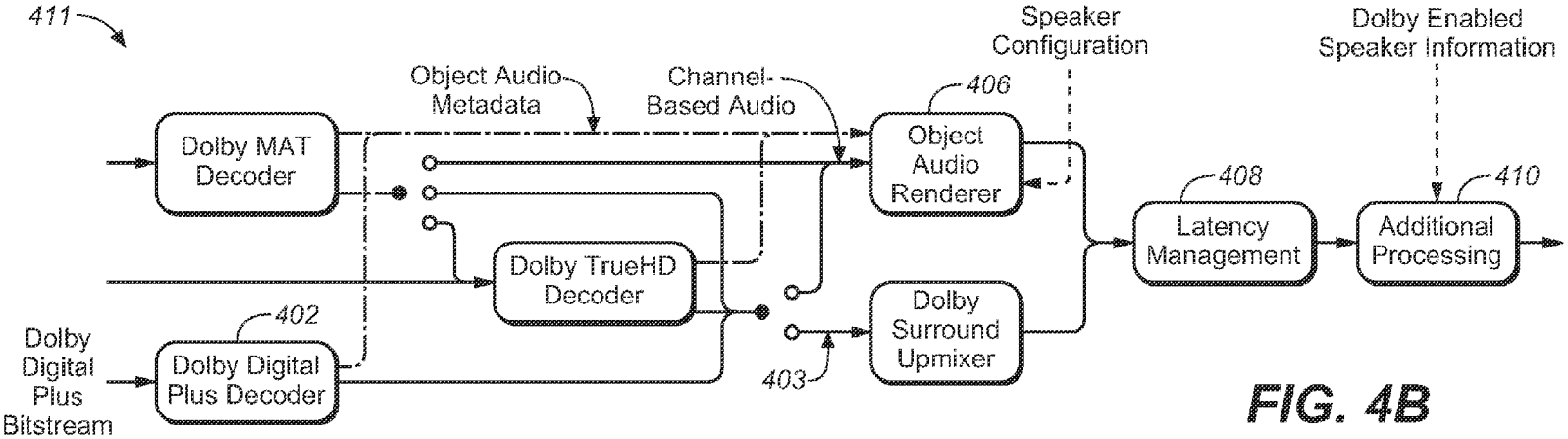
FIG. 4B illustrates a processing path for object-based decoding and rendering in the adaptive audio AVR system of FIG. 4A, under an embodiment.

FIGS. 4A and 4B illustrate the different processing paths traversed for object-based decoding and rendering versus channel-based decoding and upmixing in an adaptive audio AVR system, under an embodiment. FIG. 4A shows a processing path and the signal flow for channel-based decoding and upmixing in an adaptive audio AVR system, and FIG. 4B shows the processing path and signal flow for object-based decoding and rendering in the same AVR system. The input bitstream, which may be a Dolby Digital Plus or similar bitstream, may change between object-based and channel-based content over time. As the content changes, the decoder 402 (e.g., Dolby Digital Plus decoder) is configured to output in-band metadata that encodes or indicates the audio configuration (object vs. channel). As shown in FIG. 4A, the channel-based audio within the input bitstream is processed through an upmixer 404 that also receives speaker configuration information; and as shown in FIG. 4B, the object-based audio within the input bitstream is processed through an object audio renderer (OAR) 406 that also receives the appropriate speaker configuration information. The OAR interfaces with the AVR system 411 through an object audio renderer interface (OARI) 306, shown in FIG. 3. The use of in-band metadata that is encoded with the audio content, and that encodes the audio type allows the upmixer 404 and renderer 406 to choose the appropriate audio to process. Thus, as shown in FIGS. 4A and 4B, the upmixer 404 will detect the presence of channel-based audio through the in-line metadata and only process the channel-based audio, while ignoring the object-based audio. Likewise, the renderer 406 will detect the presence of object-based audio through the in-line metadata and only process the object-based audio, while ignoring the channel-based audio. This in-line metadata effectively allows the system to switch between the appropriate post-decoder processing components (e.g., upmixer, OAR) based directly on the type of audio content detected by these components, as shown by virtual switch 403.

When switching between rendered audio (object-based) and upmixed audio (channel-based), it is also important to manage latency. The upmixer 404 and renderer 406 may both have differing, non-zero latencies. If the latency is not accounted for, then audio/video synchronization may be affected, and audio glitches may be perceived. The latency management may be handled separately, or it may be handled by the renderer or upmixer. When the renderer or upmixer is first initialized, each component is queried for its latency in samples, such as through a latency-determining algorithm within each component. When the renderer or upmixer becomes active, the initial samples generated by the component algorithm equal to its latency are discarded. When the renderer or upmixer becomes inactive, an extra number of zero samples equal to its latency are processed. Thus, the number of samples output is exactly equal to the number of samples input. No leading zeroes are output, and no stale data is left in the component algorithm. Such management and synchronization is provided by the latency management component 408 in systems 400 and 411. The latency manager 408 is also responsible for joining the output of upmixer 404 and renderer 406 into one continual audio stream. In an embodiment, the actual latency management function may be handled internally to both the upmixer and renderer by discarding leading zeros and processing extra data for each respective received audio segment according to latency processing rules. The latency manager thus ensures a time-aligned output of the different signal paths. This allows the system to handle bitstream changes without producing audible and objectionable artifacts that may otherwise be produced due to multiple playback conditions and the possibility of changes in the bitstream.

In an embodiment, latency alignment occurs by pre-compensating for known latency differences during the initialization phase. During consecutive audio segments, samples may be dropped because the audio doesn't align to a minimum frame boundary size (e.g., in the Channel Audio Renderer) or the system is applying "fades" to minimize transients. As shown in FIGS. 4A and 4B, the latency synchronized audio is then processed through one or more additional post-processes 410 that may utilize adaptive-audio enabled speaker information that provides parameters regarding sound steering, object trajectory, height effects, and so on.

In an embodiment, in order to enable switching on bitstream parameters, the upmixer 404 must remain initialized in memory. This way, when a loss of adaptive audio content is detected, the upmixer can immediately begin upmixing the channel-based audio.

Figure 5:
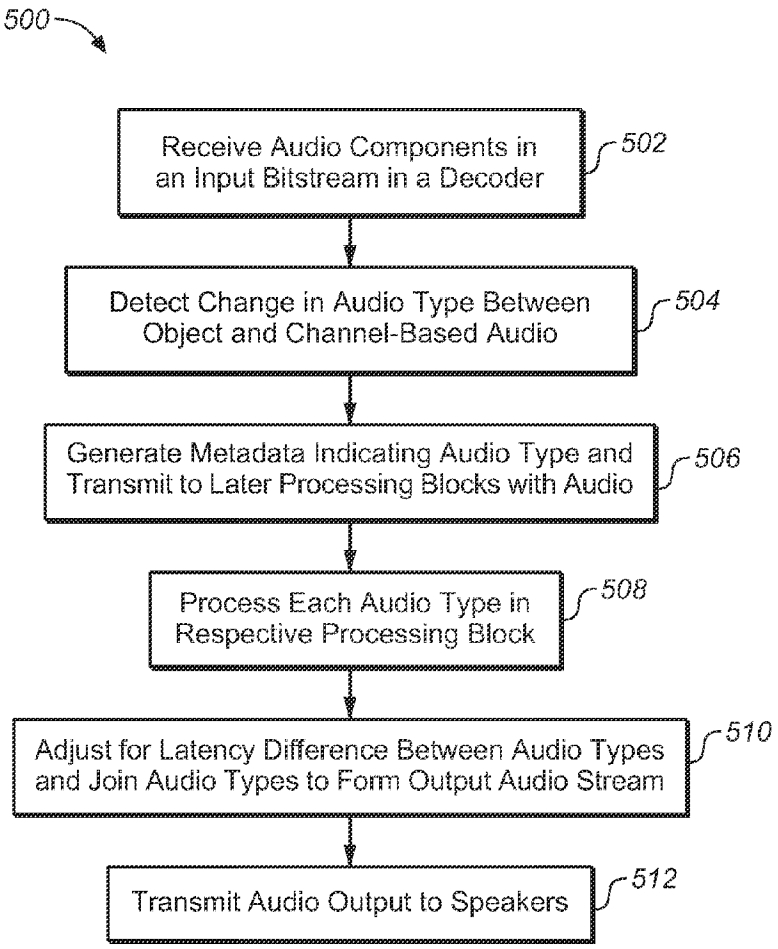
FIG. 5 is a flowchart that illustrates a method of providing in-band signaling metadata to switch between object-based and channel-based audio data, under an embodiment.

FIG. 5 is a flowchart that illustrates a method of providing in-band signaling metadata to switch between object-based and channel-based audio data, under an embodiment. As shown in process 500 of FIG. 5, an input bitstream having channel-based and object-based audio at different times is received in a decoder, 502. The decoder detects the changes in the audio type as it receives the bitstream, 504. The decoder internally generates metadata indicating the audio type for each received segment of audio and encodes this generated metadata with each segment of audio for transmission to downstream processors or processing blocks, 506. Thus, channel-based audio segments are each encoded with a channel identifying metadata definition (tagged as channel-based), and object-based audio segments are each encoded with object identifying metadata definition (tagged as object-based). Each processing block after the decoder detects the type of incoming audio signal segment based on this in-line signaling metadata, and processes it or ignores it accordingly, 508. Thus, an upmixer or other similar process will process audio segments that are signaled to be channel-based, and an OAR or similar process will process audio segments that are signaled to be object-based. Any latency difference between successive audio segments are adjusted through latency management processes within the system, or within each downstream processing block, and the audio streams are joined to form an output audio stream, 510. The output stream is then transmitted to a surround-sound speaker array, 512.

By utilizing the in-band metadata signaling mechanism and by managing the latency, the audio system of FIG. 3 is capable of receiving and processing audio that is changing between objects and channels over time, and maintains constant audio output for all requested speaker feeds without glitches, mutes, or audio/video synchronization drift. This allows the distribution and processing of audio content that contains both new (e.g., Dolby Atmos audio/video) content and legacy (e.g., surround-sound audio) content in the same bitstream. By using an appropriate upmixer 304, an AVR or other devices can switch between content types, causing minimal spatial distortion. This allows newly developed AVR products to be able to receive changes in a bitstream, such as bit-rate and channel configuration, without any resulting audio dropouts or undesirable audio artifacts, which is especially important as the industry moves towards new forms of content delivery and adaptive streaming scenarios. The described surround upmix technology plays an important role in helping decoders handle these bitstream changes.

It should be noted that the system of FIG. 3, as further detailed in FIGS. 4A and 4B, represents an example of a playback system for adaptive audio, and other configurations, components, and interconnections are also possible. For example, the decoder 302 may be implemented as a microcontroller coupled to two separate processors (DSPs) for upmixing and object rendering, and these components may be implemented as separate devices coupled together by a physical transmission interface or network. The decoder microcontroller and processing DSPs may be each contained within a separate component or subsystem or they may be separate components contained in the same subsystem, such as an integrated decoder/renderer component. Alternatively, the decoder and post-decoder processes may be implemented as separate processing components within a monolithic integrated circuit device.

Metadata Definition

In an embodiment, the adaptive audio system includes components that generate metadata from an original spatial audio format. The methods and components of the described systems comprise an audio rendering system configured to process one or more bitstreams containing both conventional channel-based audio elements and audio object coding elements. The spatial audio content from the spatial audio processor comprises audio objects, channels, and position metadata. Metadata is generated in the audio workstation in response to the engineer's mixing inputs to provide rendering queues that control spatial parameters (e.g., position, velocity, intensity, timbre, etc.) and specify which driver(s) or speaker(s) in the listening environment play respective sounds during exhibition. The metadata is associated with the respective audio data in the workstation for packaging and transport by an audio processor.

In an embodiment, the audio type (i.e., channel or object-based audio) metadata definition is added to, encoded within, or otherwise associated with the metadata payload transmitted as part of the audio bitstream processed by an adaptive audio processing system. In general, authoring and distribution systems for adaptive audio create and deliver audio that allows playback via fixed speaker locations (left channel, right channel, etc.) and object-based audio elements that have generalized 3D spatial information including position, size and velocity. The system provides useful information about the audio content through metadata that is paired with the audio essence by the content creator at the time of content creation/authoring. The metadata thus encodes detailed information about the attributes of the audio that can be used during rendering. Such attributes may include content type (e.g., dialog, music, effect, Foley, background/ambience, etc.) as well as audio object information such as spatial attributes (e.g., 3D position, object size, velocity, etc.) and useful rendering information (e.g., snap to speaker location, channel weights, gain, ramp, bass management information, etc.). The audio content and reproduction intent metadata can either be manually created by the content creator or created through the use of automatic, media intelligence algorithms that can be run in the background during the authoring process and be reviewed by the content creator during a final quality control phase if desired.

In an embodiment, there are several different metadata types that work together to describe the data. First, there is a connection between each processing node, such as between the decoder and upmixer or renderer. This connection contains a data buffer, and a metadata buffer. As described in greater detail below with respect to the OARI, the metadata buffer is implemented as a list, with pointers into certain byte offsets of the data buffer. The interface for the node to the connection is through the "pin". A node may have zero or more input pins, and zero or more output pins. A connection is made between the input pin of one node and the output pin of another node. One trait of a pin is its data type. That is, the data buffer in the connection may represent various different types of data—PCM audio, encoded audio, video, etc. It is the responsibility of a node to indicate through its output pin what type of data is being output. A processing node should also query its input pin, so that it knows what type of data is being processed.

Once a node queries its input pin, it can then decide how to process the incoming data. If the incoming data is PCM audio, then the node needs to know exactly what the format of that PCM audio is. The format of the audio is described by a "pcm_config" metadata payload structure. This structure describes e.g., the channel count, the stride, and the channel assignment of the PCM audio. It also contains a flag "object_audio", which if set to 1 indicates the PCM audio is object-based, or set to 0 if the PCM audio is channel-based, though other flag setting values are also possible. In an embodiment, this pcm_config structure is set by the decoder node, and received by both the OARI and CAR nodes. When the rendering node receives the pcm_config metadata update, it checks the object_audio flag and reacts accordingly, beginning a new stream or ending a current stream as needed.

Many other metadata types may be defined by the audio processing framework. In general, a metadatum consists of an identifier, a payload size, an offset into the data buffer, and an optional payload. Many metadata types do not have any actual payload, and are purely informational. For instance, the "sequence start" and "sequence end" signaling metadata have no payload, as they are just signals without further information. The actual object audio metadata is carried in "Evolution" frames, and the metadata type for Evolution has a payload size equal to the size of the Evolution frame, which is not fixed and can change from frame to frame. The term Evolution frame generally refers to a secure, extensible metadata packaging and delivery framework in which a frame can contain one or more metadata payloads and associated timing and security information. Although embodiments are described with respect to Evolution frames, it should be noted that any appropriate frame configuration that provides similar capabilities may be used.

Object Audio Renderer Interface

As shown in FIG. 3, the object-based audio is processed through an object audio renderer interface 306 that includes or wraps around an object audio renderer (OAR) to rendering the object-based audio. In an embodiment, the OARI 306 receives the audio data from decoder 302 and processes the audio data that has been signaled by appropriate in-line metadata as object-based audio. The OARI generally works to filter metadata updates for certain AVR products and playback components such as adaptive-audio enabled speakers and soundbars. It implements techniques such as proper alignment of metadata with incoming buffered samples; adapting the system to varying complexities to meet processor needs; intelligent filtering of metadata updates that do not align on block boundaries; and filtering metadata updates for applications like a soundbar and other specialized speaker products.

The object audio renderer interface is essentially a wrapper for the object audio renderer that performs two operations: first, it deserializes Evolution framework and object audio metadata bitstreams; and second, it buffers input samples and metadata updates that are to be processed by the OAR at the appropriate time and with the appropriate block size. In an embodiment, the OARI implements an asynchronous input/output API (application program interface), where samples and metadata updates are pushed onto the input audio bitstream. After this input call is made, the number of available samples is returned to the caller, and then those samples are processed.

Figure 6:
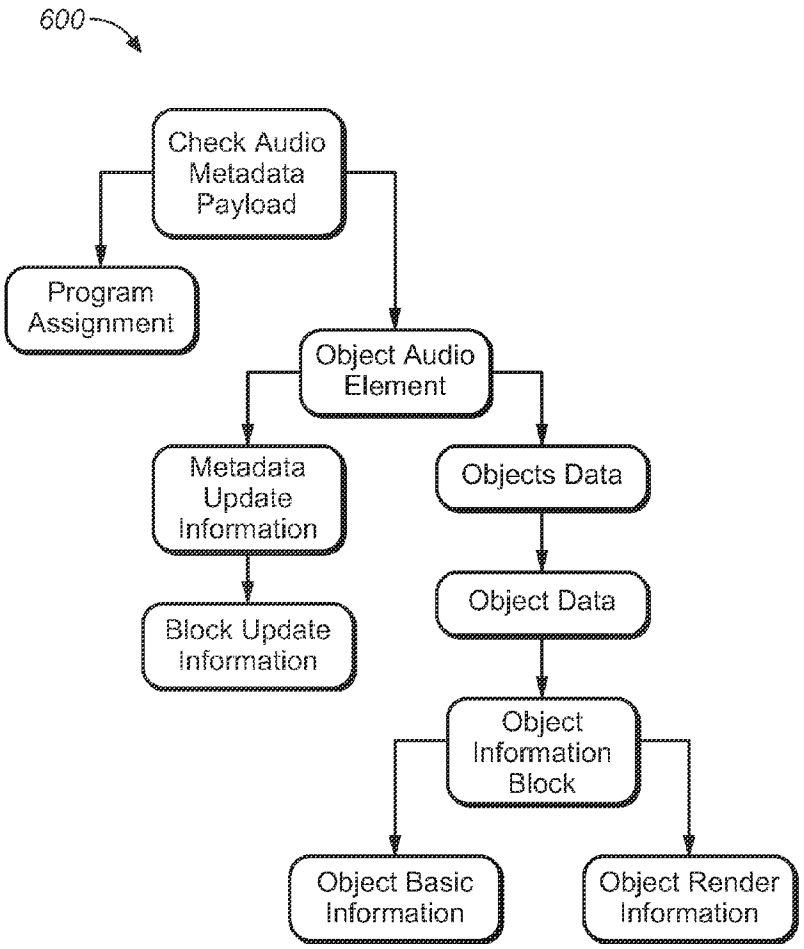
FIG. 6 illustrates the organization of metadata into a hierarchical structure as processed by an object audio renderer, under an embodiment.

The object audio metadata contains all relevant information needed to render an adaptive audio program with an associated set of object-based PCM audio outputs from a decoder (e.g., Dolby Digital Plus, Dolby TrueHD, Dolby MAT decoder, or other decoder). FIG. 6 illustrates the organization of metadata into a hierarchical structure as processed by an object audio renderer, under an embodiment. As shown in diagram 600, an object audio metadata payload is divided into a program assignment and associated object audio element. The object audio element comprises data for multiple objects, and each object data element has an associated object information block that contains object basic information and object render information. The object audio element also has metadata update information and block update information for each object audio element.

Figure 7:
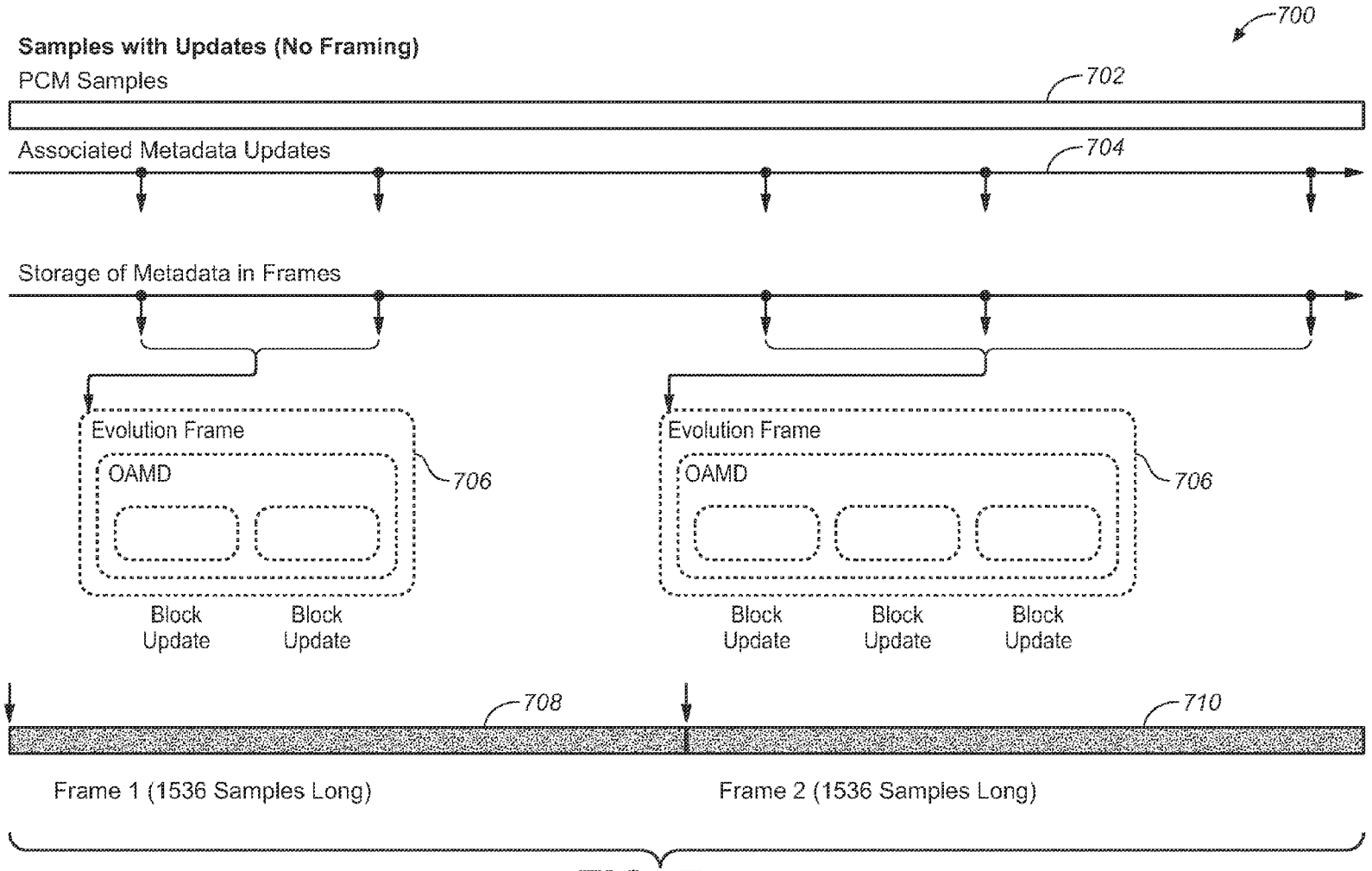
FIG. 7 illustrates the application of metadata updates and the framing of metadata updates within a first type of codec, under an embodiment.

The PCM samples of the input audio bitstream are associated with certain metadata that defines how those samples are rendered. As the objects and rendering parameters change, the metadata is updated for new or successive PCM samples. With regard to metadata framing, the metadata updates can be stored differently depending on the type of codec. In general, however, when codec-specific framing is removed, metadata updates shall have equivalent timing and render information, independent of their transport. FIG. 7 illustrates the application of metadata updates and the framing of metadata updates within a first type of codec, under an embodiment. Depending on the data codec used, all frames contain a metadata update that may contain multiple blocks in a single frame, or the access units may contain updates, generally with only one block per frame. As shown in diagram 700, PCM samples 702 are associated with periodic metadata updates 704. In the diagram, five such updates are shown. In certain codecs, such as the Dolby Digital Plus format, one or more metadata updates may be stored in Evolution frame 706, which contains the object audio metadata and block updates for each associated metadata update. Thus, the example of FIG. 7 shows the first two metadata updates stored in a first Evolution frame with two block updates, and the next three metadata updates stored in a second Evolution frame with three block updates. These Evolution frames correspond to uniform frames 708 and 710, each of a defined number of samples (e.g., 1536 samples long for a Dolby Digital Plus frame).

Figure 8:
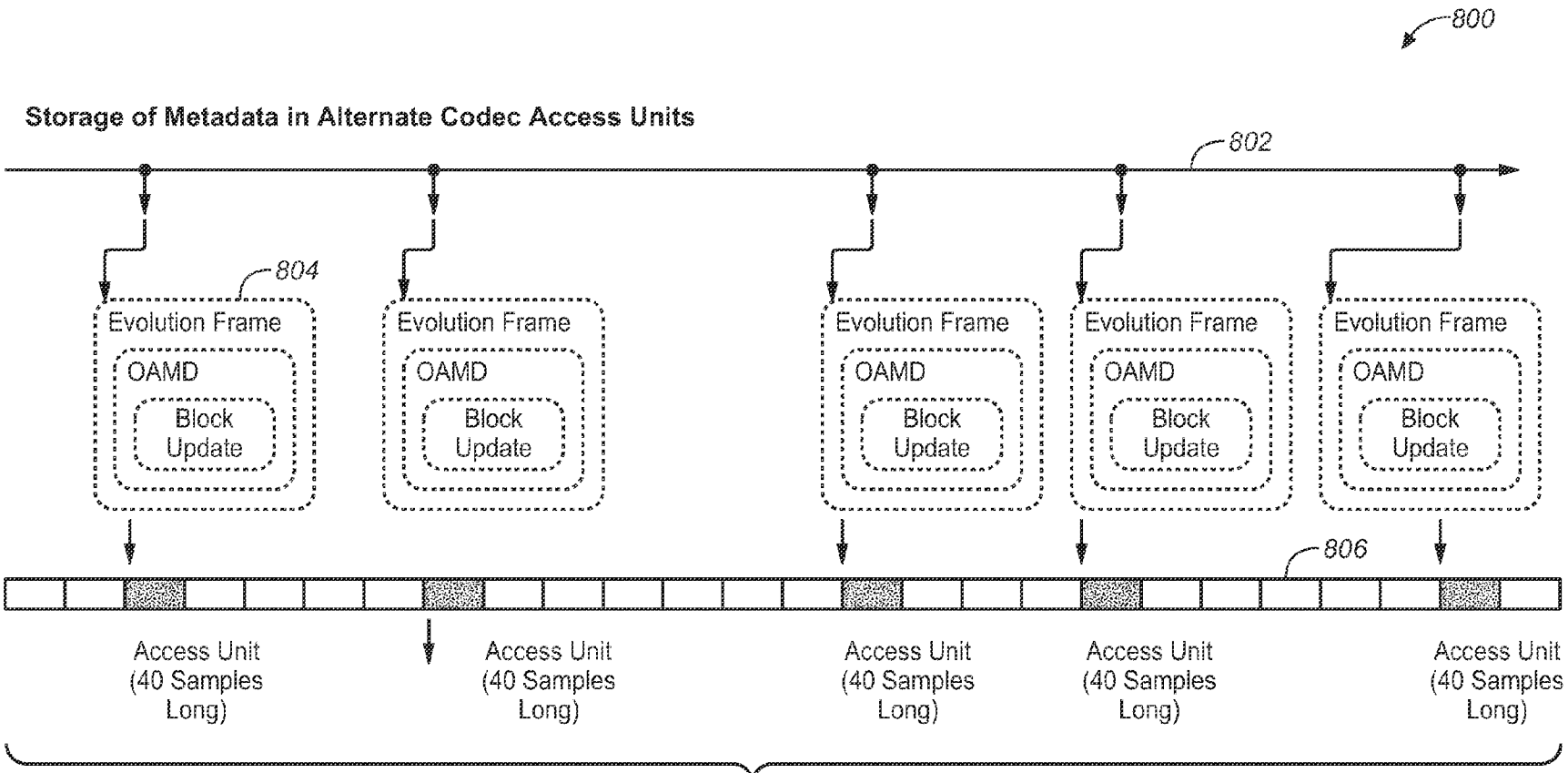
FIG. 8 illustrates the application of metadata updates and the framing of metadata updates within a second type of codec, under an alternative embodiment.

The embodiment of FIG. 7 illustrates storage of metadata updates for one type of codec, such as a Dolby Digital Plus codec. However, other codecs and framing schemes may be used. FIG. 8 illustrates the storage of metadata according to an alternative framing scheme for use with a different codec, such as a Dolby TrueHD codec. As shown in diagram 800, metadata updates 802 are each packaged into a corresponding Evolution frame 804 that has an object audio metadata element (OAMD) and an associated block update. These are framed into Access Units 806 of a certain number of samples (e.g., 40 samples for a Dolby TrueHD codec). Although embodiments have been described for certain example codecs, such as Dolby Digital Plus and Dolby TrueHD, it should be noted that any appropriate codec for object-based audio may be used, and the metadata framing scheme may be configured accordingly.

OARI Operation

Figure 11:
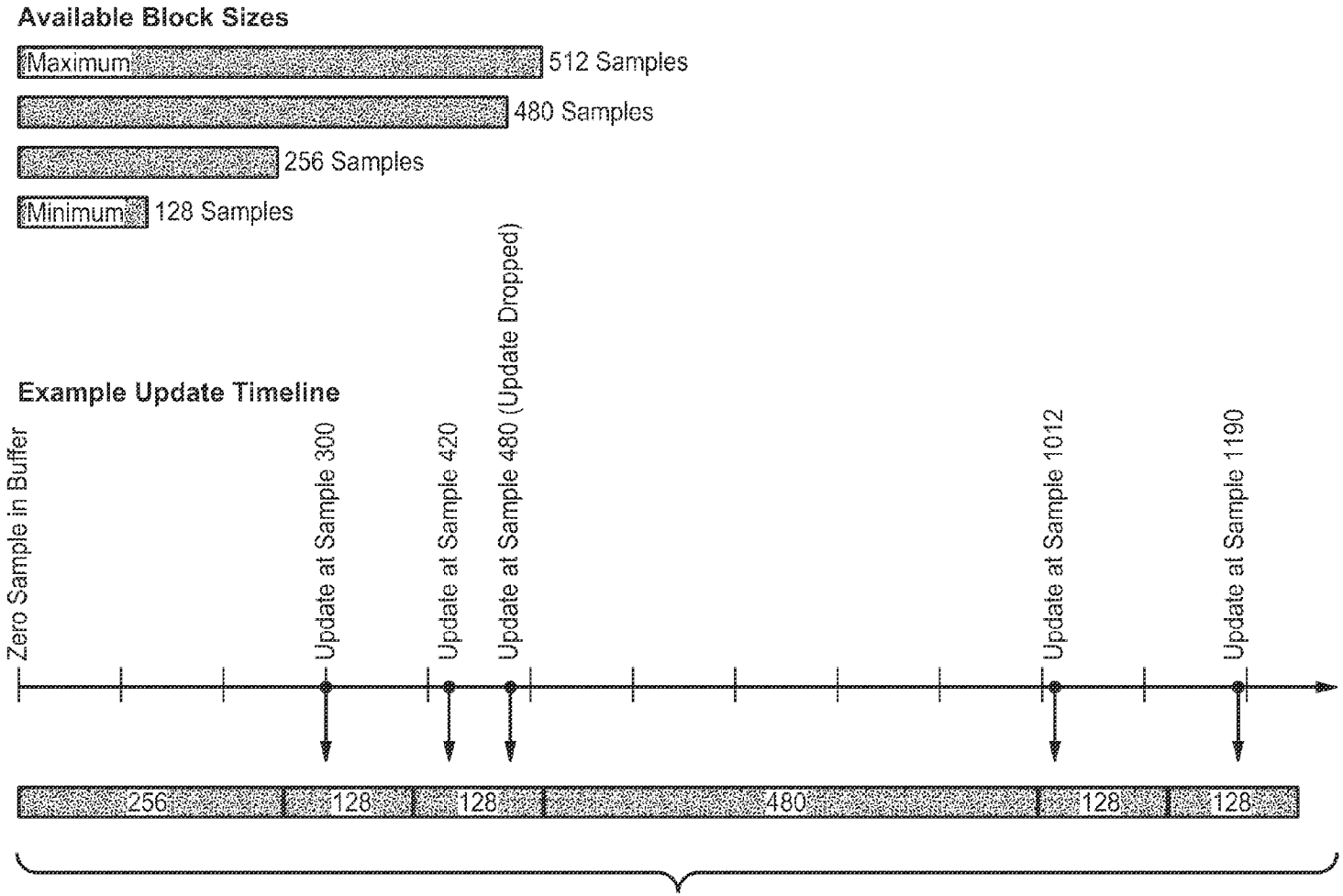
FIG. 11 illustrates the application of metadata updates by the object audio renderer interface, under an embodiment.
Figure 12:
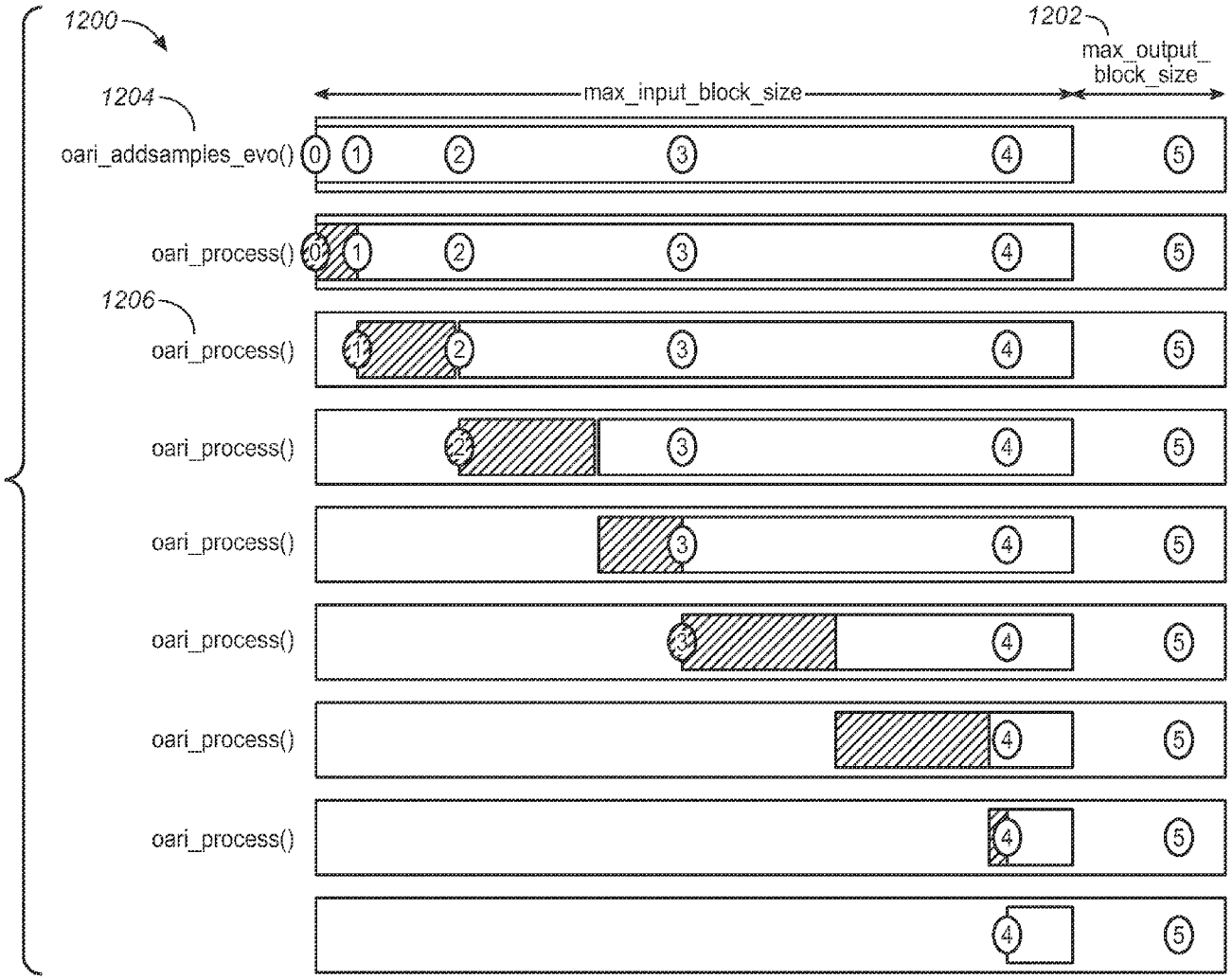
FIG. 12 illustrates an example of an initial processing cycle performed by the object audio renderer interface, under an embodiment.
Figure 13:
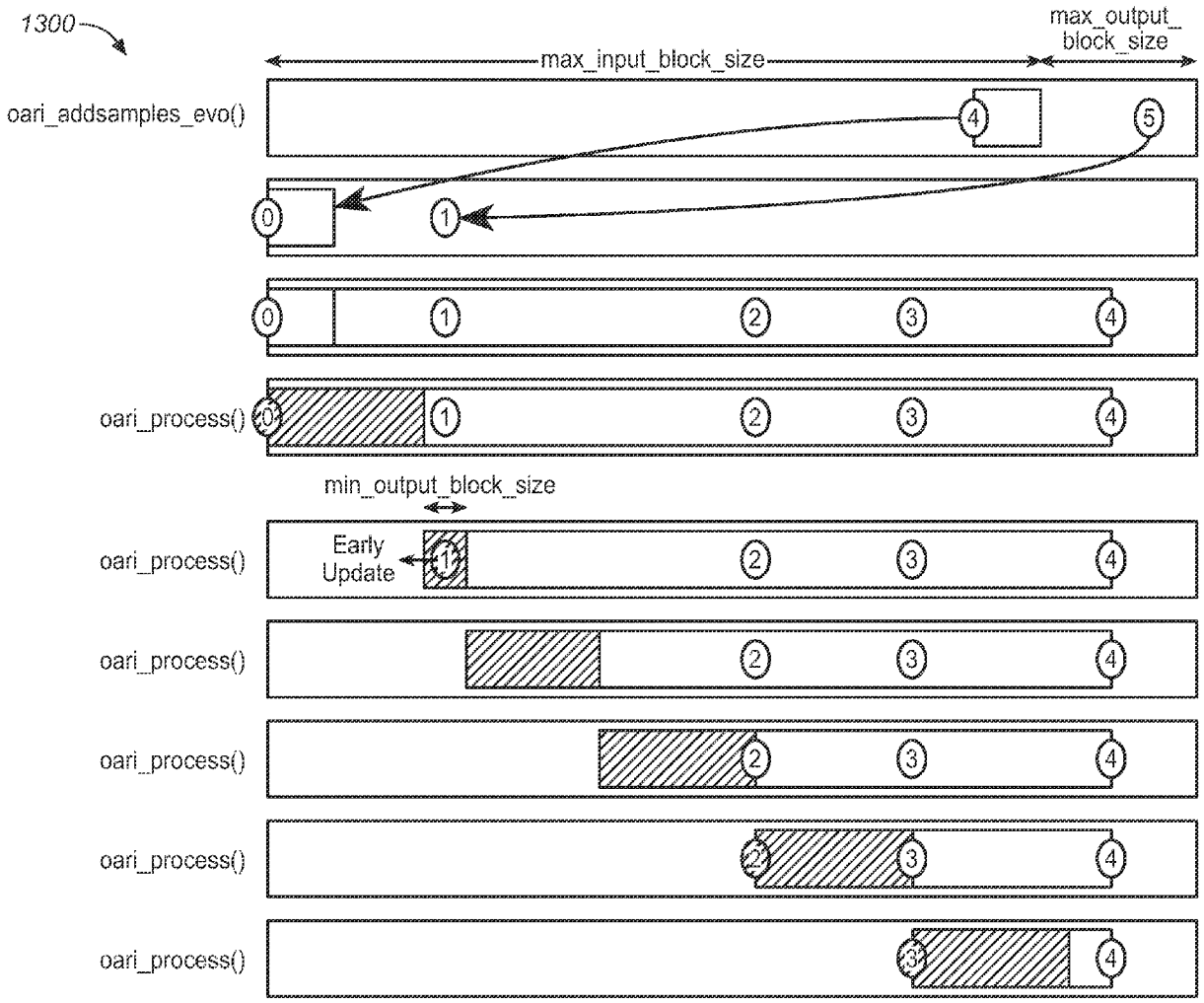
FIG. 13 illustrates a subsequent processing cycle following the example processing cycle of FIG. 12.

The object audio renderer interface is responsible for the connection of audio data and Evolution metadata to the object audio renderer. To achieve this, the object audio renderer interface (OARI) provides audio samples and accompanying metadata to the object audio renderer (OAR) in manageable data portions or frames. FIGS. 7 and 8 illustrate how metadata updates are stored in the audio coming into the OARI, and the audio samples and accompanying metadata for the OAR are illustrated in FIGS. 11, 12 and 13.

Figure 9:
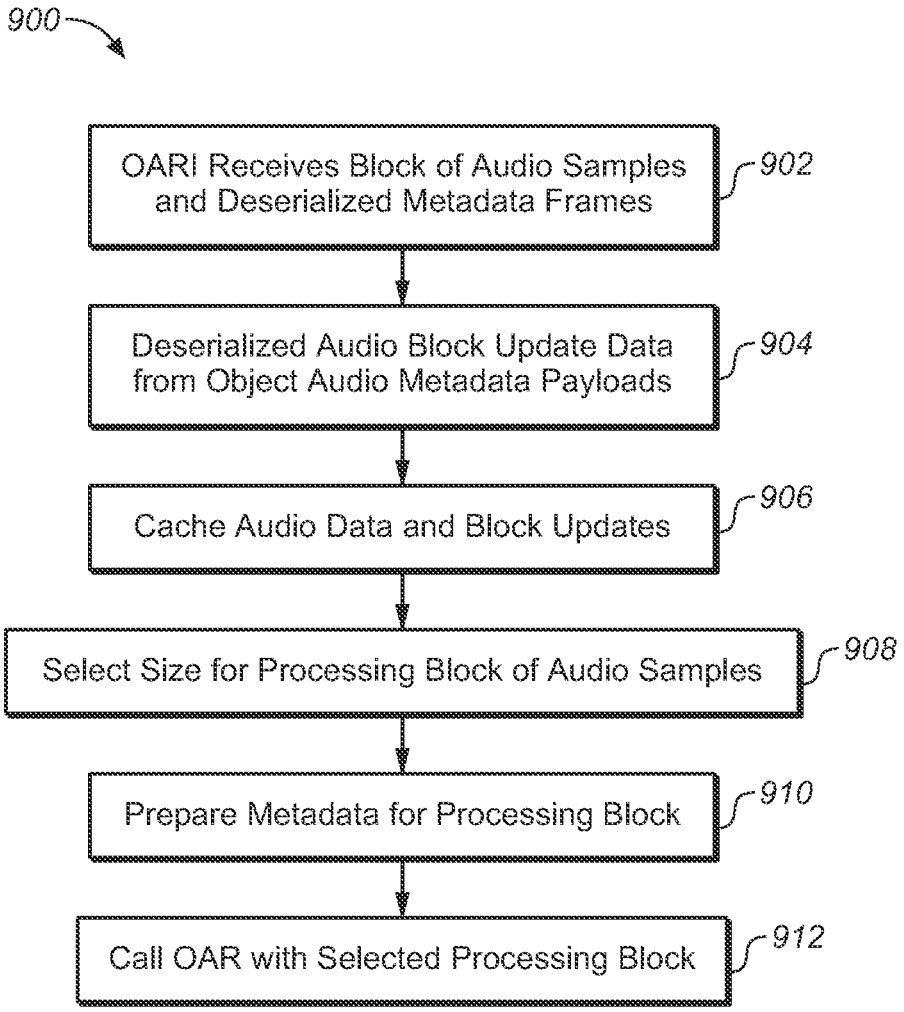
FIG. 9 is a flow diagram illustrating process steps performed by an object audio renderer interface, under an embodiment.

The object audio renderer interface operation consists of a number of discrete steps or processing operations, as shown in the flow diagram 900 of FIG. 9. The method of FIG. 9 generally illustrates a process of processing object-based audio by receiving, in an object audio renderer interface (OARI), a block of audio samples and one or more associated object audio metadata payloads, de-serializing one or more audio block updates from each object audio metadata payload, storing the audio samples and the audio block updates in respective audio sample and audio block update memory caches, and dynamically selecting processing block sizes of the audio samples based on timing and alignment of audio block updates relative to processing block boundaries, and one or more other parameters including maximum/minimum processing block size parameters. In this method, the object-based audio is transmitted from the OARI to the OAR in processing blocks of sizes determined by the dynamic selection process.

With reference to FIG. 9, the object audio renderer interface first receives a block of audio samples and deserialized evolution metadata frames, 902. The audio sample block can be of arbitrary size, such as up to a max_input_block_size parameter passed in during the object audio renderer interface initialization. The OAR may be configured to support a limited number of block sizes, such as block sizes of: 32, 64, 128, 256, 480, 512, 1024, 1536, and 2048 samples in length, but is not so limited, and any practical block size may be used.

The metadata is passed as a deserialized evolution framework frame with a binary payload (e.g., data type evo_payload_t) and a sample offset, indicating at which sample in the audio block the Evolution framework frame applies. Only Evolution framework payloads containing object audio metadata are passed to the object audio renderer interface. Next, the audio block update data is deserialized from the object audio metadata payloads, 904. Block updates carry spatial position and other metadata (such as object type, gain, and ramp data) about a block of samples. Depending on system configuration, up to e.g., eight block updates are stored in an object audio metadata structure. The offset calculation incorporates the Evolution framework offset, the progression of the object audio renderer interface sample cache, and offset values of the object audio metadata, in addition to individual block updates. The audio data and block updates are then cached, 906. The caching operation retains the relationship between the metadata and the sample positions in the cache. As shown in block 908, the object audio renderer interface selects a size for a processing block of audio samples. The metadata is then prepared for the processing block, 910. This step includes certain procedures, such as object prioritization, width removal, handling of disabled objects, filtering of updates that are too frequent for selected block sizes, spatial position clipping to a range supported by the object audio renderer (to ensure no negative Z values), and converting update data into a special format for use by the object audio renderer. The object audio renderer then is called with the selected processing block, 912.

In an embodiment, the object audio renderer interface steps are performed by API functions. One function (e.g., oari_addsamples_evo) decodes object audio metadata payloads into block updates, caches samples and block updates, and selects the first processing block size. A second function (e.g., a first oari_process) processes one block, and selects the next processing block size. An example call sequence of one processing cycle is as follows: first, one call to oari_addsamples_evo., and second, zero or more calls to oari_process provided that a processing block is available; and these steps are repeated for each cycle.

Figure 10:
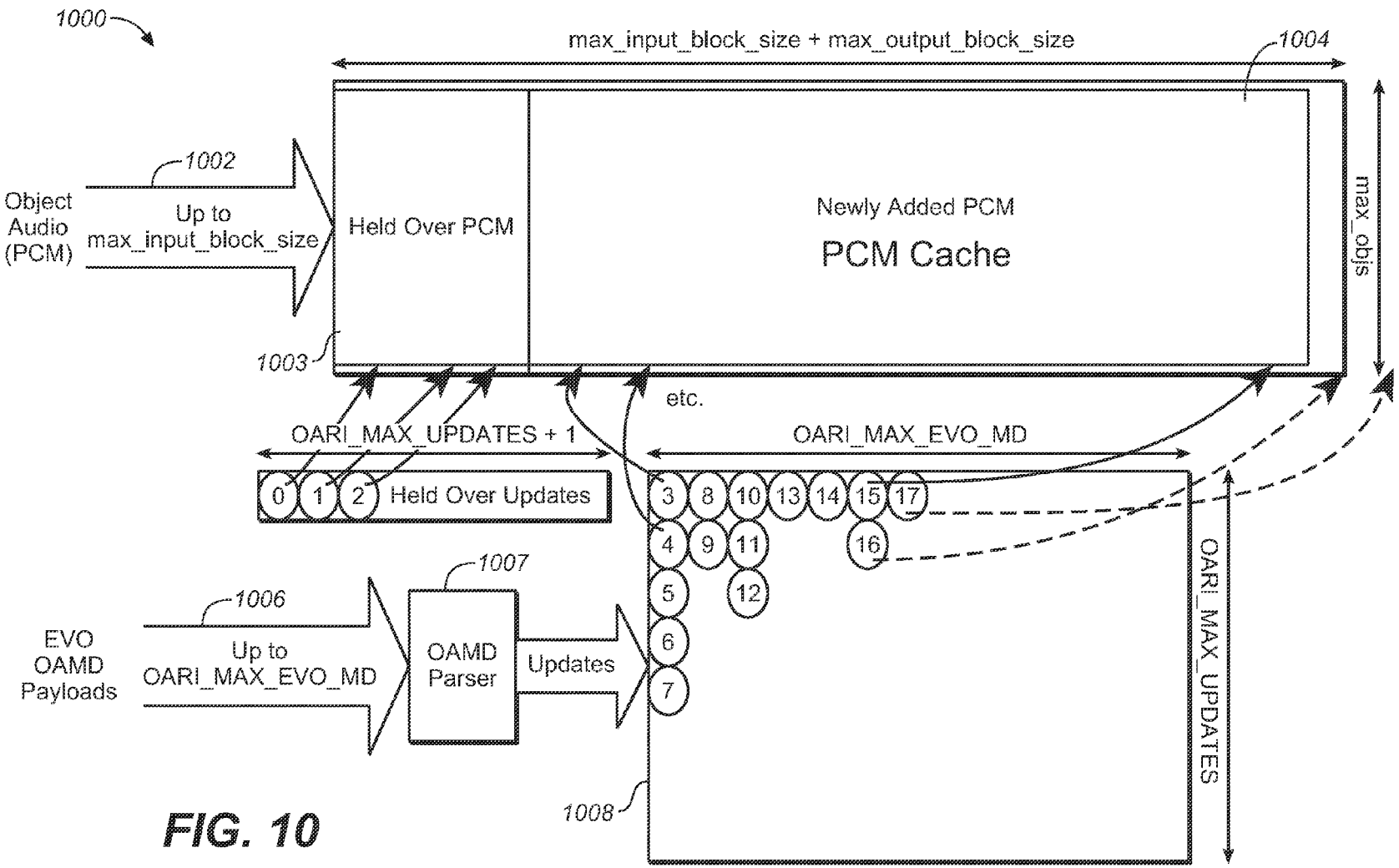
FIG. 10 illustrates the caching and deserialization processing cycle of an object audio renderer interface, under an embodiment.

As shown in step 906 of FIG. 9, the OARI performs a caching and deserializing operation. FIG. 10 illustrates in more detail the caching and deserialization processing cycle of an object audio renderer interface, under an embodiment. As shown in diagram 1000, object audio data in the form of PCM samples are input to a PCM audio cache 1004, and the corresponding metadata payloads are input to an update cache 1008 through an object audio metadata parser 1007. Block updates are represented by numbered circles, and each has a fixed relationship to a sample position in the PCM audio cache 1004, as shown by the arrows. For the example update scenario shown in FIG. 10, the last two updates are related to samples past the end of the current cache, associated with audio of a future cycle. The caching process involves retaining any unused portion of audio and the accompanying metadata from a previous processing cycle. This holdover cache for the block updates is separated from the update cache 1008, because the object audio metadata parser is always deserializing a full complement of updates into the main cache 1004. The size of the audio cache is influenced by the input parameters given at the time of initialization, such as by the max_input_block_size, max_output_block_size, and max_objs parameters. The metadata cache sizes are fixed, though it is possible to change the OARI_MAX_EVO_MD parameter inside the object audio renderer interface implementation, if needed.

To select a new value for the OARI_MAX_EVO_MD definition, the chosen max_input_block_size parameter must be considered. The OARI_MAX_EVO_MD parameter represents the number of object audio metadata payloads that can be sent to the object audio renderer interface with one call to the oari_addsamples_evo function. If the input block of samples is covered by more object audio metadata, the input size must be reduced by the calling code to arrive at the allowed amount of object audio metadata. Excess audio and object audio metadata are processed by an additional call to oari_addsamples_evo in a future processing cycle. Held over updates are sent to a held over PCM portion 1003 of the audio cache 1004. In a certain implementation, the theoretical worst case for the number of object audio metadata is max_input_block_size/40, while a more realistic worst case is max_input_block_size/128. Calling code that can handle a varying block size when calling the oari_addsamples_evo function should choose the realistic worst case, while code reliant on a fixed input block size must choose the theoretical worst case. In such an implementation, the default value for OARI_MAX_EVO_MD is 16.

Rendering objects with width (sometimes referred to as "size") generally requires more processing power than otherwise. In an embodiment, the object audio renderer interface can remove width from some or all objects. This feature is controlled by a parameter, such as a max_width_objects parameter. Width is removed from objects in excess of this count. The objects selected for width removal are of a lesser priority, if priority information is specified in the object audio metadata, or by a higher object index.

Additionally, the object audio renderer interface compensates for the processing latency introduced by the limiter in the object audio renderer. This can be enabled or disabled by a parameter setting, such as with the b_compensate_latency parameter. The object audio renderer interface compensates by dropping initial silence and by zero-flushing at the end.

As shown in step 908 of FIG. 9, the OARI performs a processing block size selection operation. A processing block is a block of samples with zero or one update. Without an update, the object audio renderer continues to use the metadata of a previous update for the new audio data. As mentioned above, the object audio renderer can be configured to support a limited number of block sizes: 32, 64, 128, 256, 480, 512, 1,024, 1,536, and 2,048 samples, though other sizes are also possible. In general, larger processing block sizes are more CPU effective. The object audio renderer may be configured to not support an offset between the start of a processing block and the metadata. In this case, the block update must be at or near the start of a processing block. In general, the block update is located as near to the first sample of the block as allowed by the minimum output block size selection. The objective of the processing block size selection is to select a processing block size as large as possible, with a block update located at the first sample of the processing block. This selection is constrained by the available object audio renderer block sizes and the block update locations. Additional constraints stem from the object audio renderer interface parameters, such as the min_output_block_size and max_output_block_size parameters. The cache size and input block size are not factors in the selection of the processing block size. If more than one update occurs within min_output_block_size samples, only the first update is retained and any additional updates are discarded. If a block update is not positioned at the first sample of the processing block, the metadata applies too early, resulting in an imprecise update. The maximum possible imprecision is given by a parameter values, such as min_output_block_size−1. Initial samples without any block update data result in silent output. If no update data has been received for a number of samples, the output is also muted. The number of samples until an error case is detected is given by the parameter max_lag_samples at the initialization time.

FIG. 11 illustrates the application of metadata updates by the object audio renderer interface, under an embodiment. In this example, min_output_block_size is set to 128 samples and max_output_block_size is set to 512 samples. Therefore, four possible block sizes are available for processing as follows: 128, 256, 480, and 512. FIG. 11 illustrates the process of selecting the correct size of samples to send to the object audio renderer. In general, determining the proper block size is based on certain criteria based on optimizing overall computational efficiency by calling the maximum block size possible given certain conditions. For a first condition, if there are two updates that are closer together than the minimum block size, the second update should be removed prior to the calculation of the block size determination. The block size should be chosen such that: a single update applies to the block of samples to be processed, the update is a close as possible to the first sample in the block to be processed; the block size must be no smaller than the max_output_block_size parameter value passed during initialization; and the block size must be no larger than the max_output_block_size parameter value passed in during initialization.

FIG. 12 illustrates an example of an initial processing cycle performed by the object audio renderer interface, under an embodiment. As shown in diagram 1200, metadata updates are represented by numbers circles from 1 to 5. The processing cycle begins with a call to the oari_addsamples_evo function 1204 that fills the audio and metadata caches, and is followed by a series of oari_process rendering functions 1206. Thus, after the call to function 1204, a call is made to the first oari_process function, which sends a first block of audio together with update 0 to the object audio renderer. The block and update areas are shown as hatched areas in FIG. 12. Subsequently, the progression through the sample cache is shown with each function call 1206. Note how the maximum output block size is enforced, that is the size of each hatched area does not exceed the max_output_block_size 1202. For the example shown, updates 2 and 3 have more audio data associated with them than allowed by the max_output_block_size parameter and are therefore sent as multiple processing blocks. Only the first processing block has update metadata. The last chunk is not yet processed, because it is smaller than max_output_block_size. The processing block selection is waiting for additional samples in the next round to maximize the processing block. A subsequent call to the oari_addsamples_evo function is made, starting a new processing cycle. As can be seen in the Figure, update 5 applies to audio that has not yet been added.

In the subsequent processing cycle, the oari_addsamples_evo function first moves all remaining audio to the start of the cache and adjusts the offset of the remaining updates. FIG. 13 illustrates a second processing cycle following the example processing cycle of FIG. 12. The oari_addsamples_evo function then adds the new audio and metadata after the held-over content in the cache. The processing of update 1 shows an enforcement of the max_output_block_size parameter. The second processing block of update 0 is smaller than this parameter and is therefore expanded to match this minimum size. As a result, the processing block now contains update 1, which must be processed along this block of audio. Because update 1 is not located at the first sample of the processing block, but the object audio renderer applies it there, the metadata is applied early. This results in a lowered precision of the audio rendering.

With respect to metadata timing, embodiments include mechanisms to maintain accurate timing when applying metadata to the object audio renderer in the object audio renderer interface. One such mechanism includes the use of sample offset fields in an internal data structure. FIG. 14 illustrates a table (Table 1) that lists fields used in the calculation of the offset field in the internal oari_md_update data structure, under an embodiment.

For higher sample rates, some of the indicated sample offsets must be scaled. The time scale of the following bit fields is based on the audio sample rate:

Timestamp
oa_sample_offset
block_offset_factor

The oa_sample_offset bit field is given by the combination of the oa_sample_offset_type, oa_sample_offset_type, and oa_sample_offset fields. The value of these bit fields must be scaled by a scale factor dependent on the audio sampling frequency, as listed in the following Table 2.

TABLE 2

| Associated Audio Sampling Frequency (kHz) | Time Scale Basis (kHz) | Scale Factor |
|---|---|---|
| 48 | 48 | 1 |
| 96 | 48 | 2 |
| 192 | 48 | 4 |
| 44.1 | 44.1 | 1 |
| 88.2 | 44.1 | 2 |
| 176.4 | 44.1 | 4 |

For example, if a 96 kHz bitstream Evolution framework payload has a payload offset of 2,000 samples, then this value must be scaled by the scale factor of 2, and the time stamp in the evolution framework payload must indicate 1,000 samples. Because the object audio metadata payload has no knowledge of the audio sampling rate, it assumes a time-scale basis of 48 kHz, which has a scale factor of 1. It is important to note that within object audio metadata, the ramp duration value (given by the combination of the ramp_duration_code, use_ramp_table, ramp_duration_table, and ramp_duration fields) also uses a time-scale basis of 48 kHz. The ramp_durationvalue must be scaled according to the sampling frequency of the associated audio.

Once the scaling operation is performed, a final sample offset calculation may be made. In an embodiment, the equation for the overall calculation of the offset value is given by the following program routine:

```
/* N represents the number of metadata blocks in the
object audio metadata payload and
must be in the range [1, 8] */
for (i=0; i<N; i++) {
  metadata_update_buffer[i].offset = sample_offset +
(timestamp * fs_scale_factor) +
    (oa_sample_offset * fs_scale_factor) + (32 * block_
offset_factor[i] * fs_scale_factor);
}
```

The object audio renderer interface dynamically adjusts processing block sizes of the audio based on timing and alignment of metadata updates, as well as maximum/minimum block size definitions, and other possible factors. This allows metadata updates to occur optimally with respect to the audio blocks to which the metadata is meant to be applied. Metadata can thus be paired with the audio essence in a way that accommodates rendering of multiple objects and objects that update non-uniformly with respect to the data block boundaries, and in a way that allows the system processors to function efficiently with respect to processor cycles.

Although embodiments have been described and illustrated with respect to implementation in one or more specific codecs, such as Dolby Digital Plus, MAT 2.0, and TrueHD, it should be noted that any codec or decoder format may be used.

Aspects of the audio environment of described herein represents the playback of the audio or audio/visual content through appropriate speakers and playback devices, and may represent any environment in which a listener is experiencing playback of the captured content, such as a cinema, concert hall, outdoor theater, a home or room, listening booth, car, game console, headphone or headset system, public address (PA) system, or any other playback environment. Although embodiments have been described primarily with respect to examples and implementations in a home theater environment in which the spatial audio content is associated with television content, it should be noted that embodiments may also be implemented in other consumer-based systems, such as games, screening systems, and any other monitor-based A/V system. The spatial audio content comprising object-based audio and channel-based audio may be used in conjunction with any related content (associated audio, video, graphic, etc.), or it may constitute standalone audio content. The playback environment may be any appropriate listening environment from headphones or near field monitors to small or large rooms, cars, open air arenas, concert halls, and so on.

Aspects of the systems described herein may be implemented in an appropriate computer-based sound processing network environment for processing digital or digitized audio files. Portions of the adaptive audio system may include one or more networks that comprise any desired number of individual machines, including one or more routers (not shown) that serve to buffer and route the data transmitted among the computers. Such a network may be built on various different network protocols, and may be the Internet, a Wide Area Network (WAN), a Local Area Network (LAN), or any combination thereof. In an embodiment in which the network comprises the Internet, one or more machines may be configured to access the Internet through web browser programs.

One or more of the components, blocks, processes or other functional components may be implemented through a computer program that controls execution of a processor-based computing device of the system. It should also be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

Reference throughout this specification to "one embodiment", "some embodiments" or "an embodiment" means that a particular feature, structure or characteristic described in connection with the embodiment is included in at least one embodiment of the discloses system(s) and method(s). Thus, appearances of the phrases "in one embodiment", "in some embodiments" or "in an embodiment" in various places throughout this description may or may not necessarily refer to the same embodiment. Furthermore, the particular features, structures, or characteristics may be combined in any suitable manner as would be apparent to one of ordinary skill in the art.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of processing adaptive audio content, comprising:

determining an audio type as one of channel-based audio and object-based audio for each audio segment of an adaptive audio bitstream comprising a plurality of audio segments;

tagging the each audio segment with a metadata definition indicating the audio type of the corresponding audio segment;

processing audio segments tagged as channel-based audio in a channel audio renderer component;

processing audio segments tagged as object-based audio in an object audio renderer component that is distinct from the channel audio renderer component, wherein the channel audio renderer component and the object audio renderer component have non-zero and differing latencies, and both of said renderer components are queried for their respective latency in samples upon their first initialization for managing latency when switching between processing object-based audio segments and channel-based audio segments.

2. The method of claim 1 further comprising encoding the metadata definition as an audio type metadata element encoded as part of a metadata payload associated with each audio segment.

3. The method of claim 1 wherein the metadata definition comprises a binary flag value that is set by a decoder component and that is transmitted to the channel audio renderer component and object audio renderer component.

4. The method of claim 3 wherein the binary flag value is decoded by the channel audio renderer component and object audio renderer component for each received audio segment, and wherein audio data in the audio segment is rendered by one of the channel audio renderer component and object audio renderer component based on the decoded binary flag value.

5. The method of claim 1 wherein the channel-based audio comprises legacy surround-sound audio and the channel audio renderer component comprises an upmixer, and further wherein the object audio renderer component comprises an object audio renderer interface.

6. A method of rendering adaptive audio, comprising:

receiving, in a decoder, input audio comprising channel-based audio and object-based audio segments encoded in an audio bitstream;

detecting a change of type between the channel-based audio and object-based audio segments in the decoder;

generating a metadata definition for each type of audio segment upon detection of the change of type;

associating the metadata definition with the appropriate audio segment;

processing each audio segment in an appropriate post-decoder processing component depending on the associated metadata definition, wherein each post-decoder processing component has a non-zero latency different from the latency of the respective other post-decoder processing component, and the post-decoder processing components are queried for their respective latency in samples upon their first initialization for managing latency when switching between processing object-based audio segments and channel-based audio segments.

7. The method of claim 6 wherein the channel-based audio comprises legacy surround-sound audio to be rendered through an upmixer of an adaptive audio rendering system, and further wherein the object-based audio is rendered through an object audio renderer interface of the adaptive audio rendering system.

8. The method of claim 6 wherein the metadata definition comprises an audio-type flag encoded by the decoder as part of a metadata payload associated with the audio bitstream.

9. The method of claim 8 wherein a first state of the flag indicates that an associated audio segment is channel-based audio and a second state of the flag indicates that the associated audio segment is object-based audio.

10. A system for rendering adaptive audio, comprising:

a decoder receiving input audio in a bitstream having audio content and associated metadata, the audio content having an audio type comprising one of channel-based audio or object-based type audio at any one time;

an upmixer coupled to the decoder for processing the channel-based audio;

an object audio renderer interface coupled to the decoder in parallel with the upmixer for rendering the object-based audio through an object audio renderer;

a metadata element generator within the decoder configured to tag channel-based audio with a first metadata definition and to tag object-based audio with a second metadata definition; and a latency manager configured to adjust for transmission and processing latency between any two successive audio segments by pre-compensating for known latency differences during an initialization phase to provide time-aligned output of different signal paths through the upmixer and object audio renderer interface for the successive audio segments, wherein the upmixer and the object-audio renderer both have non-zero and differing latencies, and the upmixer and the object-audio renderer are queried for their latency in samples upon their first initialization.

11. The system of claim 10 wherein the upmixer receives both the tagged channel-based audio and tagged object-based audio from the decoder and processes only the channel-based audio.

12. The system of claim 10 wherein the object audio renderer interface receives both the tagged channel-based audio and tagged object-based audio from the decoder and processes only the object-based audio.

13. The system of claim 10 wherein the metadata element generator sets a binary flag indicating the type of audio segment transmitted from the decoder to the upmixer and the object audio renderer interface, and wherein the binary flag is encoded by the decoder as part of a metadata payload associated with the bitstream.

14. The system of claim 10 wherein the channel-based audio comprises surround-sound audio beds, the audio objects comprise objects conforming to an object audio metadata (OAMD) format.

15. A method of switching between channel-based audio and object-based audio rendering, comprising:

encoding a metadata element to have a first state indicating channel-based audio content or a second state indicating object-based audio content for an associated audio block;

transmitting the metadata element as part of an audio bitstream comprising a plurality of audio blocks to a decoder;

decoding the metadata element for each audio block in the decoder to route channel-based audio content to a channel audio renderer (CAR) if the metadata element is of the first state and object-based audio content to an object audio renderer (OAR) if the metadata element is of the second state, wherein the channel audio renderer and the object audio renderer both have a non-zero and differing latency, and the channel audio renderer and the object audio renderer are queried for their latency in samples upon their first initialization for managing latency when switching between rendering object-based audio and channel-based audio.

16. The method of claim 15 wherein the metadata element comprises a metadata flag that is transmitted in-band with a pulse code modulated (PCM) audio bitstream transmitted to the decoder.

17. The method of claim 15 wherein the CAR comprises one of an upmixer or a passthrough node that maps input channels of the channel-based audio to output speakers.

18. The method of claim 15 wherein the OAR comprises a renderer that utilizes an OAR interface (OARI) that dynamically adjusts processing block sizes of the audio based on timing and alignment of metadata updates and one or more other parameters including maximum and minimum block sizes.

* * * * *